US010564575B2

(12) United States Patent
Tajiri

(10) Patent No.: US 10,564,575 B2
(45) Date of Patent: Feb. 18, 2020

(54) IMAGE FORMING APPARATUS

(71) Applicant: CANON KABUSHIKI KAISHA, Tokyo (JP)

(72) Inventor: Tsuyoshi Tajiri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 15/687,905

(22) Filed: Aug. 28, 2017

(65) Prior Publication Data

US 2017/0357192 A1 Dec. 14, 2017

Related U.S. Application Data

(62) Division of application No. 14/508,034, filed on Oct. 7, 2014, now Pat. No. 9,778,601.

(30) Foreign Application Priority Data

Oct. 10, 2013 (JP) ..... 2013-212983

(51) Int. Cl.
*G03G 15/08* (2006.01)
*G03G 15/16* (2006.01)

(52) U.S. Cl.
CPC ..... *G03G 15/1615* (2013.01)

(58) Field of Classification Search
CPC ..... G03G 15/01; G03G 15/16; G03G 15/08
USPC ..... 399/121
See application file for complete search history.

(56) References Cited

U.S. PATENT DOCUMENTS 7,400,852 B2 7/2008 Furukawa
8,346,139 B2 1/2013 Okamoto
2007/0059054 A1 3/2007 Furukawa
2007/0116496 A1 5/2007 Morimoto et al.
2008/0240800 A1 10/2008 Furukawa
(Continued)

FOREIGN PATENT DOCUMENTS

CN 1928728 A 3/2007
JP 2006-323235 A 11/2006
JP 2007-079570 A 3/2007
(Continued)

OTHER PUBLICATIONS

Office Action in Chinese Patent Application No. 201410529171.3 dated Dec. 5, 2016.
(Continued)

*Primary Examiner* — Clayton E. LaBalle
*Assistant Examiner* — Fang-Chi Chang
(74) *Attorney, Agent, or Firm* — Venable LLP

(57) ABSTRACT

An image forming apparatus includes: an image carrying unit; a unit-to-be-moved; a pulse motor; a moving mechanism including a rotatable member provided with a member-to-be-detected; a detecting portion; an executing portion; and a controller for causing the executing portion to execute a first stop mode on the basis of detection of the detecting portion when the unit-to-be-moved is changed in position from the second or third position to the first position and to execute a second stop mode on the basis of a pulse number of a driving signal when the unit-to-be-moved is changed in position from the first or third position to the second position and when the unit-to-be-moved is changed in position from the first or second position to the third position, and for making the change at least between the second and third positions by only unidirectional rotation of the pulse motor.

10 Claims, 23 Drawing Sheets

(56) References Cited

U.S. PATENT DOCUMENTS

| | | | |
|---|---|---|---|
| 2011/0158690 | A1 | 6/2011 | Mimbu et al. |
| 2013/0136498 | A1 | 5/2013 | Ju et al. |

FOREIGN PATENT DOCUMENTS

| | | | |
|---|---|---|---|
| JP | 2007-232941 | A | 9/2007 |
| JP | 2008-102164 | A | 5/2008 |
| JP | 2009-036919 | A | 2/2009 |
| JP | 2009-128698 | A | 6/2009 |
| JP | 2010-134149 | A | 6/2010 |
| JP | 2010-282124 | A | 12/2010 |
| JP | 4645481 | B2 | 3/2011 |
| JP | 2011-175033 | A | 9/2011 |
| JP | 2013-195875 | A | 9/2013 |

OTHER PUBLICATIONS

Office Action dated Apr. 17, 2018, in Japanese Patent Application No. 2017-149982.

[FULL-CLR]

[ALL SEPARATION]

[FULL-CLR]

(a)

(b)

[MONOCHROMATIC]

(a)

(b)

[ALL SEPARATION]

[FULL-CLR → MONOCHROMATIC]

[MONOCHROMATIC → FULL-CLR ]

[FULL-CLR → ALL SEPARATION]

IMAGE FORMING APPARATUS

FIELD OF THE INVENTION AND RELATED ART

The present invention relates to an image forming apparatus, such as a printer, a facsimile machine or a copying machine, of an electrophotographic type or an electrostatic recording type.

Various conventional image forming apparatuses employing an image forming process of the electrophotographic type or the electrostatic recording type exist, and in these image forming apparatuses, there is a type as shown below. As an example thereof, there is an intermediary transfer tandem type in which a plurality of process cartridges are arranged in line along a rotational direction of a rotatably stretched intermediary transfer belt and a color image is formed via the intermediary transfer belt.

In the image forming apparatus of such an intermediary transfer tandem type, there is an image forming apparatus in which an endless intermediary transfer belt is stretched by a plurality of stretching rollers including a driving roller. In this image forming apparatus, a primary-transfer portion is formed between a photosensitive drum and a primary-transfer roller which are provided opposed to each other at a position, between the two stretching rollers, where the intermediary transfer belt is sandwiched between the photosensitive drum and the primary-transfer roller. Further, a secondary-transfer portion is formed between an inner secondary-transfer roller and an outer secondary-transfer roller, capable of performing a contact-and-separation operation relative to the inner secondary-transfer roller, which are provided opposed to each other so as to sandwich the intermediary transfer belt in a downstream side of a rotational direction of the intermediary transfer belt.

In a full-color image forming apparatus of the intermediary transfer tandem type, there is a constitution in which image formation is effected using, e.g., four colors (yellow, magenta, cyan, black) and in which an operation in a monochromatic mode (Bk single-color mode) in which the image formation for only black (Bk) is effected is executable. In the case where a monochromatic mode image is formed by this constitution, rotation of photosensitive drums and developing devices, for yellow, magenta and cyan, which are not required to be operated is stopped, so that deterioration of the photosensitive drums and developers is prevented and thus a running cost of the apparatus can be reduced.

In an operation in a full-color mode in which a full-color image is formed by using the photosensitive drums for all the four colors, the intermediary transfer belt is contacted to all the operating photosensitive drums for yellow, magenta, cyan and black. On the other hand, in the operation in the monochromatic mode, the intermediary transfer belt is temporarily separated (spaced) from the photosensitive drums, for yellow, magnet and cyan, which are stopped. Further, during maintenance of a transfer unit including the intermediary transfer belt or the like and during transportation or the like of the image forming apparatus, also an operation in an all separation mode in which the intermediary transfer belt is separated (spaced) from all the photosensitive drums, for yellow, magenta, cyan and black, which are stopped exists.

In such an image forming apparatus, as disclosed in Japanese Laid-Open Patent Application (JP-A) 2010-282124, there is a constitution in which a plurality of primary-transfer rollers and a plurality of stretching rollers are supported by a fixed frame for supporting the plurality of stretching rollers via a movable frame which is swingable and in which the movable frame is selectively swung. As a result, the operation in the monochromatic mode is carried out after the primary-transfer rollers for the colors other than black are separated from the corresponding photosensitive drums, and the operation in the full-color mode is carried out after all the primary-transfer rollers are moved toward the corresponding photosensitive drums. Alternatively, also an image forming apparatus capable of executing an operation in an all separation mode, as another mode, in which all the primary-transfer rollers are separated from the corresponding photosensitive drums during the maintenance and during the transportation of the apparatus has been known.

On the other hand, also an image forming apparatus operable in a separation mode in which the outer secondary-transfer roller is separated from the intermediary transfer belt when the toner image does not exist on the intermediary transfer belt exists. In this image forming apparatus, by preventing contamination and deterioration of the secondary-transfer roller by the toner deposited on the intermediary transfer belt in a region other than an image forming region, service life extension is intended. In this apparatus, there is also a constitution in which during maintenance of a secondary-transfer unit including the outer secondary-transfer roller or the like and during the apparatus transportation, the outer secondary-transfer roller is further largely spaced. Also in such an apparatus, a control position is switched among a position of an operation in a contact mode in which the outer secondary-transfer roller is contacted to the intermediary transfer belt during the image formation, a position of an operation in a separation mode in which the outer secondary-transfer roller is separated from the intermediary transfer belt and a stand-by position between these positions.

In this way, in a constitution having three modes with respect to a contact secondary-transfer of the primary-transfer rollers or the secondary-transfer roller, a constitution such that the three modes are switched by a single sensor and a single motor in order to reduce a user stress by further shortening of a switching time and to reduce an apparatus cost is applied. In the image forming apparatus operable in the three modes, as a constitution applied to a developing roller or the like without being limited to the transfer roller as disclosed in JP-A 2006-323235, there is a constitution in which the position of the operation in the separation mode is set at the stand-by position and in which the three modes are switched by the single sensor and the single motor.

However, in the image forming apparatus disclosed in JP-A 2010-282124, the stand-by position is the separation mode position, and therefore when the monochromatic mode and the full-color mode are repetitively switched by normal rotation and reverse rotation of the motor, there is a liability that an error is accumulated. In this case, there is a possibility that a problem such that the apparatus cannot be stopped finally in the operation in a desired mode and thus the toner image is not transferred or a lifetime is shortened arises. In order to avoid this problem, it would be also considered that a rotational direction of the motor is always set unidirectionally, but in this case, a time required for switching becomes long. In this way, the switch of the mode with reliability and the short switch time were in a trade-off relationship.

Further, also in the image forming apparatus disclosed in JP-A 2006-323235, in order to return the position to the stand-by position during power-on of the apparatus or during an initializing operation for separation switch, there is a need to always once detect all of flags. For that reason, the motor has to be rotated once every time, so that there was a problem such that a rising time of the apparatus becomes long.

As described above, when the mode switching time or the apparatus rising time becomes large, downtime of the apparatus becomes long, so that there is a possibility that a new problem of stress applied to a user or a short lifetime of the apparatus occurs.

SUMMARY OF THE INVENTION

According to an aspect of the present invention, there is provided an image forming apparatus comprising: an image carrying unit for carrying a toner image; a unit-to-be-moved for being moved so as to change a position thereof relative to the image carrying unit; a pulse motor rotatable bi-directionally on the basis of a pulse number of a driving signal; a moving mechanism, including a rotatable member rotatable bi-directionally in synchronism with rotation of the pulse motor, for moving the unit-to-be-moved so that predetermined three different phases of the rotatable member corresponds to first to third positions of the unit-to-be-moved, respectively, wherein the rotatable member is provided with a member-to-be-detected correspondingly to a specific phase range; a detecting portion provided at a position where the member-to-be-detected is detected when the unit-to-be-moved is in the first position; an executing portion for executing, when the unit-to-be-moved is changed in position from one of the first to third positions to another position, an operation in a first stop mode in which the rotatable member is stopped on the basis of detection of the detecting portion and an operation in a second mode in which the rotatable member is stopped on the basis of the pulse number of the driving signal sent to the pulse motor; and a controller for causing the executing portion to execute the operation in the first stop mode when the unit-to-be-moved is changed in position from the second or third position to the first position and to execute the operation in the second stop mode when the unit-to-be-moved is changed in position from the first or third position to the second position and when the unit-to-be-moved is changed in position from the first or second position to the third position, and for making the change at least between the second and third positions by only unidirectional rotation of the pulse motor.

These and other objects, features and advantages of the present invention will become more apparent upon a consideration of the following description of the preferred embodiments of the present invention taken in conjunction with the accompanying drawings.

DESCRIPTION OF THE EMBODIMENTS

First Embodiment

Figure 1:
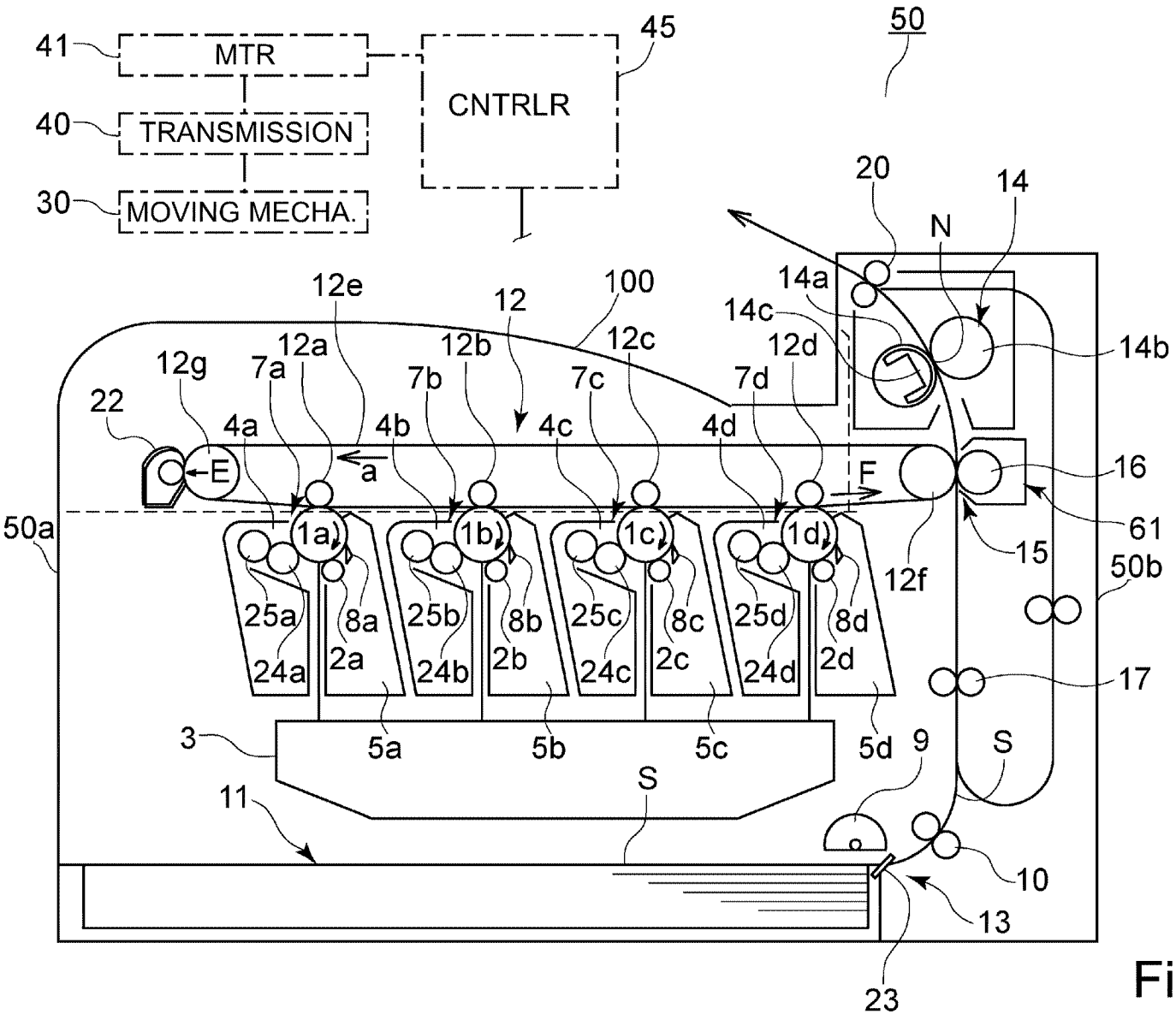
FIG. 1 is a sectional view showing a general structure of an image forming apparatus according to First Embodiment of the present invention.

With reference to the drawings, embodiments according to the present invention will be specifically described below. Throughout the drawings, the same reference numerals or symbols represent the same or corresponding portions. Incidentally, a principal part relating to formation and transfer of a toner image is principally described, but the present invention can be carried out in various uses, such as a printer, various printing machines, a copying machine and a multi-function machine, by adding necessary equipment, device and casing structure.

[Image Forming Apparatus]

First, with reference to FIG. 1, an image forming apparatus in this embodiment will be described. FIG. 1 is a schematic sectional view showing a schematic structure of an image forming apparatus 50, such as a full-color printer, of a tandem type and an intermediary transfer type.

As shown in FIG. 1, the image forming apparatus 50 includes an apparatus main assembly 50*a*. In the apparatus main assembly 50*a*, a controller 45, including ROM, RAM and CPU, for controlling respective portions of the image forming apparatus 50 is incorporated. To this controller 45, a primary-transfer contact-and-separation mechanism 30 connected via a driving motor 41 (described later) and another driving mechanism (unshown) and the like are connected.

In the image forming apparatus 50, toner image formation is effected by photosensitive drums 1 (1*a*-1*d*) as image bearing members (photosensitive members), charging rollers 2 (2*a*-2*d*) as charging means, an exposure unit 3, developing units 4 (4*a*-4*d*) as developing means, and the like.

In the following, e.g., in the case where the photosensitive drums are individually described, the photosensitive drums are represented by the reference characters 1*a*, 1*b*, 1*c*, 1*d* and in the case where the photosensitive drums are collectively described, the photosensitive drums are represented by the reference character 1. This is true for other portions.

[Toner Image Forming Process]

At a periphery of the photosensitive drums 1*a*, 1*b*, 1*c*, 1*d*, along respective rotational directions, the charging rollers 2*a*, 2*b*, 2*c*, 2*d* for electrically charging surfaces of the photosensitive drums uniformly and the exposure unit 3 for forming an electrostatic latent image on each photosensitive drum by irradiating each photosensitive drum with a laser beam on the basis of image information are provided in the listed order. The developing units 4*a*, 4*b*, 4*c*, 4*d* and primary-transfer rollers 12*a*, 12*b*, 12*c*, 12*d* for primary-transferring the toner images from the photosensitive drums onto an intermediary transfer belt 12*e* as a member-to-be-moved are provided. The developing units 4*a*-4*d* visualize the electrostatic latent images into the toner images by depositing toners on the electrostatic latent images formed on the photosensitive drums. Further, cleaning means 8 (8*a*, 8*b*, 8*c*, 8*d*) for removing transfer residual toners remaining on the photosensitive drum surfaces after the primary-transfer, and the like means are provided.

The primary-transfer rollers 12*a*-12*d* are constituted so that the intermediary transfer belt 12*e* as the member-to-be-moved is movable to three different positions (arrangements) relative to the photosensitive drums (image bearing members) 1*a*-1*d* by driving the driving motor 41 consisting of a pulse motor such as a stepping motor. The driving motor 41 consisting of the pulse motor is constituted so as to be capable of being rotated and driven bi-directionally on the basis of a pulse number of a driving signal. The above-mentioned positions or the like will be described later.

The charging rollers 2 and the cleaning means 8 are assembled into a unit as cleaning units 5 (5*a*, 5*b*, 5*c*, 5*d*). The photosensitive drums 1, the cleaning units 5 and the developing units 4 and the like are integrally assembled into cartridges as process cartridges 7 (7*a*, 7*b*, 7*c*, 7*d*).

Each of the process cartridges 7*a*-7*d* is constituted so as to be insertable into and pulled out from (detachably mountable to) the apparatus main assembly 50*a*. These four process cartridges 7*a*-7*d* are different in that images different in color are formed using toners of yellow (Y), magenta (M), cyan (C) and black (Bk), but have the same basic structure.

The developing units 4*a*, 4*b*, 4*c*, 4*d* include developing rollers 24*a*, 24*b*, 24*c*, 24*d*, developer applying rollers 25*a*, 25*b*, 25*c* and 25*d*, and toner containers (not shown). In the toner containers, the toners of the colors of yellow (Y), magenta (M), cyan (C) and black (Bk), respectively, are accommodated.

The cleaning units 5*a*, 5*b*, 5*c*, 5*d* include the photosensitive drums (image bearing members, photosensitive members) 1*a*, 1*b*, 1*c*, 1*d*, the charging rollers 2*a*, 2*b*, 2*c*, 2*d*, the cleaning means 8*a*, 8*b*, 8*c* and 8*d*, are transfer residual toner collecting containers (not shown).

Each of the photosensitive drums 1*a*-1*d* is constituted by applying a layer of an organic photoconductor (OPC) onto an outer peripheral surface of an aluminum cylinder, and is rotatably supported at end portions thereof. At one of the end portions of each of the photosensitive drums 1*a*-1*d*, when a driving force is transmitted to each of the photosensitive drums 1*a*-1*d* from the driving motor (not shown), each of the photosensitive drums 1*a*-1*d* is rotationally driven in the clockwise direction indicated by an arrow in FIG. 1.

Each of the charging rollers 2*a*-2*d* is formed with an electroconductive roller in a roller shape. This charging roller is contacted to the surface of associated one of the photosensitive drums 1*a*-1*d* and is supplied with a charging voltage from a power source circuit (not shown), so that the surface of each of the photosensitive drums 1*a*-1*d* is uniformly charged. Further, the exposure unit 3 is disposed below the process cartridges 7*a*-7*d* with respect to a vertical direction, and subjects each of the photosensitive drums 1*a*, 1*b*, 1*c*, 1*d* to exposure to light on the basis of an image signal.

The developing rollers 24*a*-24*d* are disposed adjacently to the surfaces of the photosensitive drums 1*a*-1*d*, and are rotationally driven by a driving portion (not shown) and are supplied with a voltage, whereby the electrostatic images are developed on the surfaces of the photosensitive drum 1*a*-1*d*.

By the above constitution, the toner images of yellow (Y), magenta (M), cyan (C) and black (Bk) are formed on the surfaces of the photosensitive drums 1*a*-1*d*, respectively. The toner images formed on the surfaces of the photosensitive drums 1*a*-1*d* are primary-transferred successively onto the intermediary transfer belt (member-to-be-moved) 12*e*. Thereafter, the toners remaining on the photosensitive drums 1*a*-1*d* are removed by the corresponding cleaning means 8*c*-8*d*, respectively, and then are collected in transfer residual toner collecting containers (not shown) in the cleaning units 5*a*-5*d*.

[Transfer Onto Recording Material and Fixing Process]

At a lower portion of the apparatus main assembly 50*a*, a paper feeding cassette 11 for accommodating a recording material S is provided. The paper feeding cassette 11 is mounted so as to be pullable out in a frontward direction (toward a left side of the apparatus main assembly 50*a* in FIG. 1) of the apparatus main assembly 50*a*. A user accommodates, stacks and sets the recording material S in the paper feeding cassette 11 out of the apparatus main assembly 50*a*, and then inserts the paper feeding cassette 11 into the apparatus main assembly 50*a*, so that it is possible to supply the recording material S.

During the image formation, the recording material S is fed out from the paper feeding cassette 11 by a paper feeding roller 9 and then is fed to a registration roller pair 17 via a feeding roller pair 10. A paper feeding device 13 includes a semilunar paper feeding roller 9, a separating means 23 and the feeding roller pair 10 for nipping and feeding the recording material S. The registration roller pair 17 is provided downstream of the feeding roller pair 10.

The paper feeding roller 9 is provided so as to be contactable to the recording material S accommodated in the paper feeding cassette 11, and is rotated by a controller 45 at predetermined control timing, thus sending the recording material S. The sent recording material S is separated one by one by the separating means 23 and then is sent toward the downstream feeding roller pair 10. Thereafter, the recording material S is fed to the registration roller pair 17 by the feeding roller pair 10 and is once stopped at the registration roller pair 17, and thereafter is sent toward a secondary-transfer portion 15.

On the other hand, in an intermediary transfer belt unit 12 as an intermediary transfer unit, the toner images formed by the primary-transfer process are carried on the intermediary transfer belt 12*e*, and then are fed to the secondary-transfer portion 15 by the intermediary transfer belt 12*e*. The four color toner images on the intermediary transfer belt 12*e* are secondary-transferred, at the secondary-transfer portion consisting of a secondary-transfer nip, onto the recording material S fed by the registration roller pair 17 while being timed to the recording material S. That is, at the secondary-transfer portion 15, a bias is applied to an outer secondary transfer roller 16, so that the toner images are secondary-transferred from the intermediary transfer belt 12*e* onto the recording material S fed to the secondary-transfer portion 15.

At a position opposing a driving roller 12*f* as an inner secondary-transfer roller at the surface of the intermediary transfer belt 12*e*, the outer secondary-transfer roller 16 is provided. This outer secondary-transfer roller 16 is provided in a secondary-transfer unit 61 constituted so as to be detachably mountable to the apparatus main assembly 50*a*. The outer secondary-transfer roller 16 sandwiches the intermediary transfer belt 12*e* between itself and the driving roller 12*f*, and the secondary-transfer portion 15 is formed between the outer secondary-transfer roller 16 and the intermediary transfer belt 12*e*.

The fixing device 14 disposed downstream of the secondary-transfer portion 15 includes a fixing belt 14*a* in which a heating member 14*c* is provided, and a pressing roller 14*b* for forming a fixing nip N between itself and the fixing belt 14*a* by being pressed against the fixing belt 14*a*. The fixing belt 14*a* consists of an endless cylindrical belt, and is positioned at an outer peripheral surface thereof in a toner image surface side on the recording material. The heating member 14*c* is disposed inside the fixing belt 14*a*, and the pressing roller 14*b* is press-contacted to the fixing belt 14*a* toward the fixing belt 14*a*.

In the fixing device 14, when the pressing roller 14*b* is rotationally driven by a driving means (not shown), the fixing belt 14 is rotated together with the pressing roller 146 by the rotation of the pressing roller 14*b*, so that the fixing belt 14*a* is heated by the heating member 14*c*. When the recording material S fed from the secondary-transfer portion 15 is nipped and fed to the fixing nip N between the fixing belt 14*a* and the pressing roller 14*b*, the toner image is heated and pressed at the fixing nip N and then is fixed on the recording material S.

A paper discharging roller pair 20 is provided downstream of the fixing device 14. The recording material S subjected to fixing by the fixing device 14 is discharged via the paper discharging roller pair 20 onto a paper discharge tray 100 at an upper portion of the apparatus main assembly 50*a*.

[Intermediary Transfer Belt Unit]

Next, with reference to FIGS. 1 and 2, the intermediary transfer belt unit 12 in this embodiment will be described. Incidentally, FIG. 2 is a perspective view showing a whole of the image forming apparatus 50 so that a mounting and dismounting direction (arrow R direction) of the intermediary transfer belt unit 12 is understood.

The intermediary transfer belt unit 12 in this embodiment is constituted as a unit detachably mountable to the apparatus main assembly 50*a*. This intermediary transfer belt unit 12 is, as shown in FIG. 2, constituted so that the intermediary transfer belt unit 12 is detachably mountable to the apparatus main assembly 50*a* with respect to the arrow R direction. At a side portion (right-side portion in FIGS. 1 and 2) of the apparatus main assembly 50*a*, an openable door 50*b* supported openably relative to the apparatus main assembly 50*a*.

Figure 2:
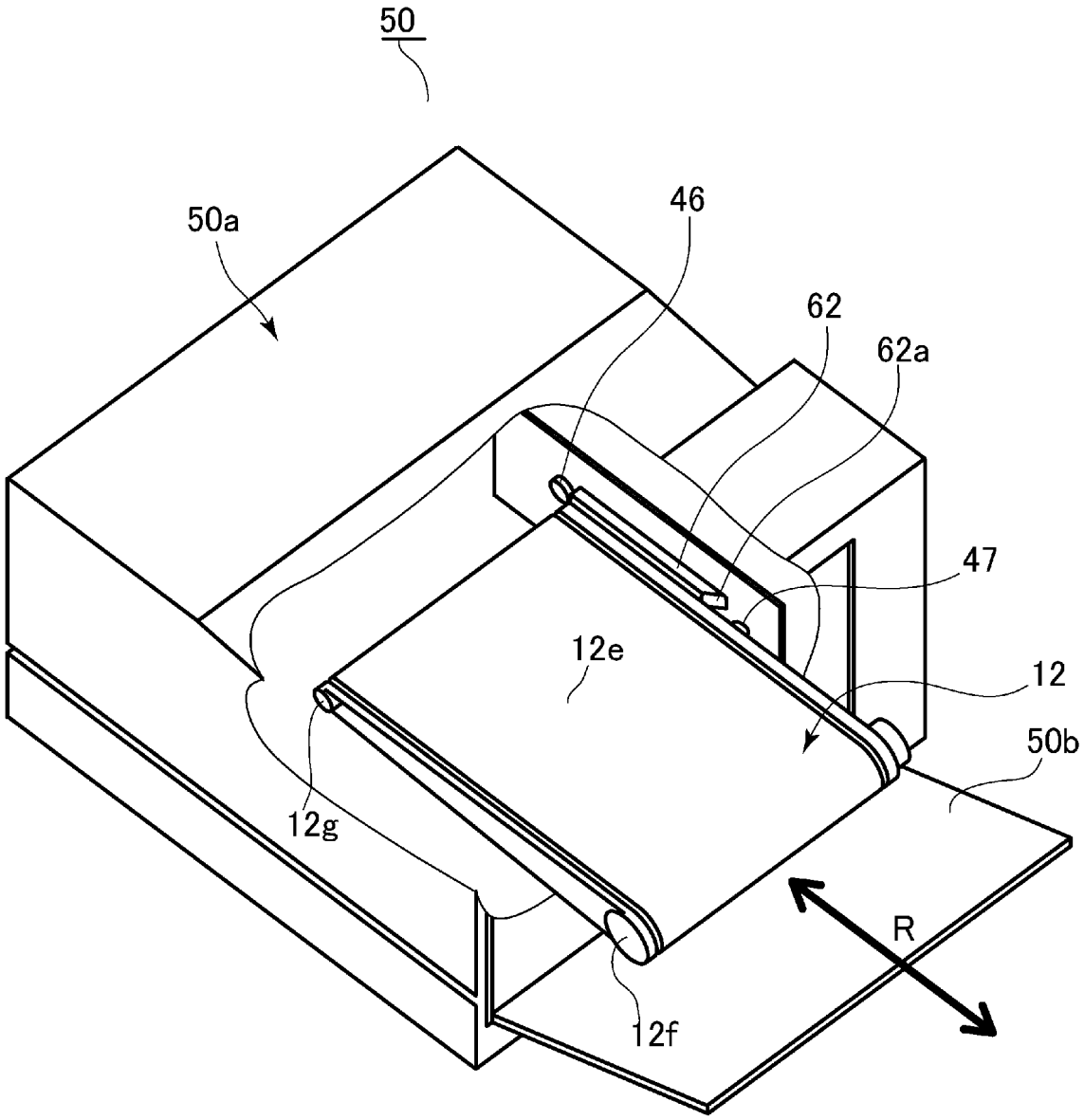
FIG. 2 is a perspective view showing a mounting and dismounting direction of an intermediary transfer belt unit in First Embodiment.

As shown in FIG. 2, when the intermediary transfer belt unit 12 is mounted into and dismounted from the apparatus main assembly 50*a* in a state in which the openable door 50*b* opens, a guiding portion 62 for guiding the intermediary transfer belt unit 12 in the mounting and dismounting direction (arrow R direction) is provided in both sides of the mounting and dismounting direction. In a front side of the guiding portion 62, an inclined guiding surface 62*a* for guiding the intermediary transfer belt unit 12 to the guiding portion 62 while press-returning the intermediary transfer belt unit 12 against an urging force of a driven coupling 47, described later, provided in the intermediary transfer belt unit 12 side is formed. This inclined guiding surface 62*a* is formed also at an unshown guiding portion (62) positioned in the front side in FIG. 2. Further, in a rear side of the guiding portion provided in one side, a driving coupling, described later, mounted in the apparatus main assembly side is provided in a projected state.

Figure 3:
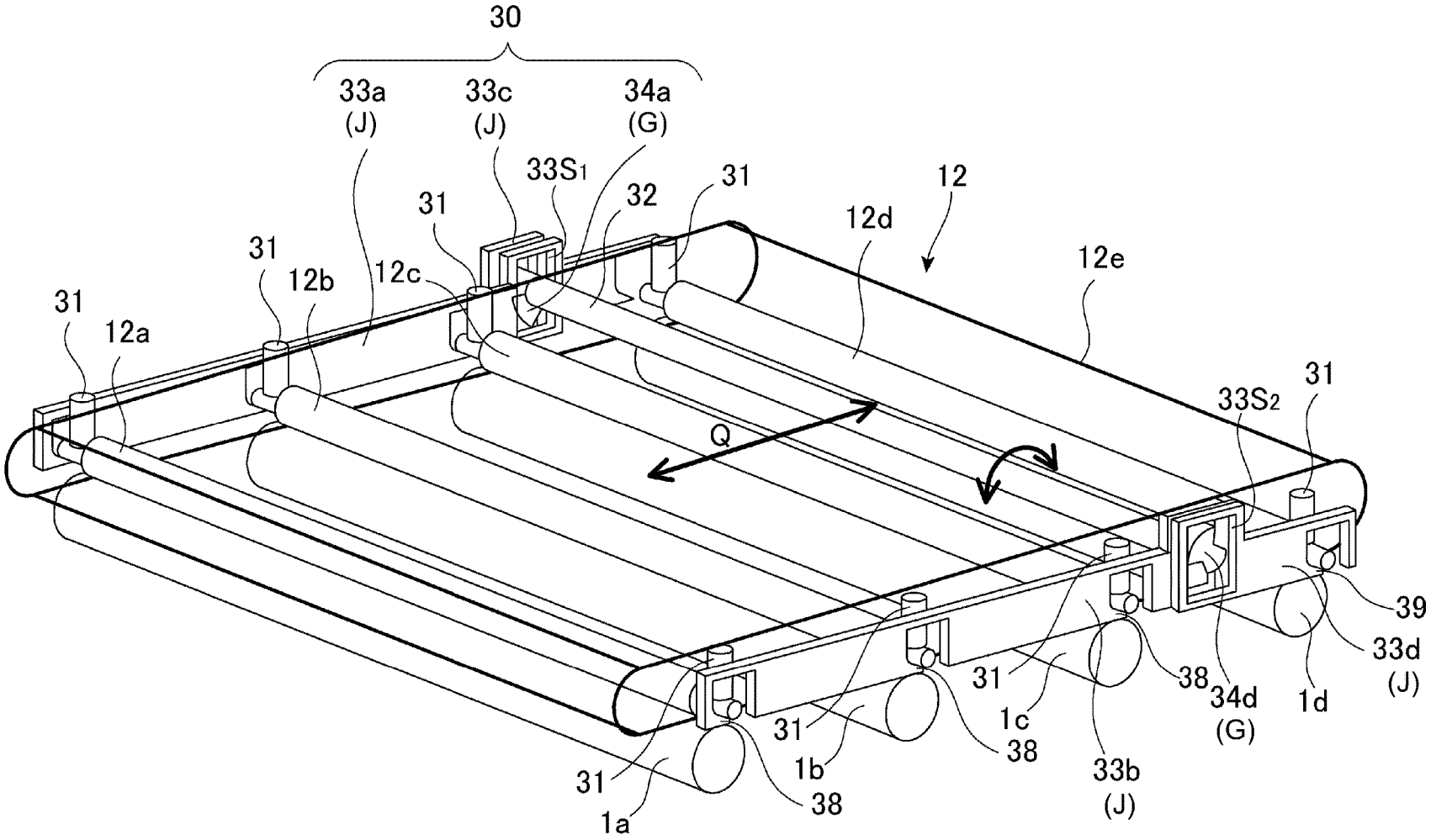
FIGS. 3, 4 and 5 are schematic perspective views showing a primary-transfer contact-and-separation mechanism in First Embodiment.

The intermediary transfer belt unit 12 includes the intermediary transfer belt 12*e*, a driving roller 12*f* as the inner secondary-transfer roller, a follower roller 12*g*, the primary-transfer rollers 12*a*-12*d* as the primary-transfer means, and a cleaning device 22. Further, the intermediary transfer belt unit 12 includes a primary-transfer contact-and-separation mechanism 30 (FIG. 3). The endless belt-like intermediary transfer belt 12*e* is stretched by the driving roller 12*f* and the follower roller 12*g*, which are a plurality of rollers, so as to be rotatable in a circumferential direction.

The follower roller 12*g* is urged in an arrow E direction in FIG. 1 by an urging means (not shown) thus applying a predetermined tension (force) to the intermediary transfer belt 12*e*. The intermediary transfer belt 12*e* is rotated in an arrow F direction in FIG. 1 at a predetermined speed by rotational drive of the driving roller 12*f* driven by a driving force of a motor (not shown).

Each of the primary-transfer rollers 12*a*-1*d* is provided in an inner peripheral surface side of the intermediary transfer belt 12*e* so as to oppose an associated one of the photosensitive drums 1*a*-1*d*, and is urged toward the associated photosensitive drum by an urging member 31 (FIG. 3) such as a compression coil spring. By applying a primary-transfer bias voltage to each of the primary-transfer rollers 12*a*-12*d*, the toner image formed on the photosensitive drums 1*a*-1*d* are successively primary-transferred onto the intermediary transfer belt 12*e*. In this way, when the four color toner images are superposedly primary-transferred onto the intermediary transfer belt 12*e*, the toner images are fed to the secondary-transfer portion 15 by the intermediary transfer belt 12*e*.

When the toner images on the intermediary transfer belt 12*e* are secondary-transferred onto the recording material S at the secondary-transfer portion 15, the transfer residual toner remaining on the intermediary transfer belt 12*e* is removed by the cleaning device 22. Then, the removed transfer residual toner is collected, via a transfer residual toner feeding path (not shown), in a transfer residual toner collecting container (not shown) provided in the apparatus main assembly 50*a*.

In the intermediary transfer belt unit 12, by the action of the primary-transfer contact-and-separation mechanism 30, the primary-transfer rollers 12*a*, 12*b*, 12*c* and Y, M, C controlled to the intermediary transfer belt 12*e* toward the photosensitive drums 1*a*, 1*b*, 1*c* during the color image formation are separated (spaced) from the photosensitive drums 1*a*-1*d*. This operation is performed for extending the lifetime of the photosensitive drums 1*a*-1*c* by avoiding friction with the photosensitive drums 1*a*-1*c* which are not used during image formation in the operation in the monochromatic mode (Bk single-color member).

Further, the primary-transfer contact-and-separation mechanism 30 has a separation constitution of the primary-transfer roller 12*d*, corresponding to Bk, operated independently of separation constitutions of the primary-transfer rollers 12*a*, 12*b*, 12*c* corresponding to Y, M, C. This is because when each of the belt unit 12 and the cartridges 7*a*-7*d* is mounted into and dismounted from the apparatus main assembly 50*a* for maintenance, damage or the like thereof by friction between the intermediary transfer belt 12*e* and the photosensitive drum 1*d* is avoided and is prevented from leading to image defect.

[Details of Primary-Transfer Contact-and-Separation Mechanism]

Next, with reference to FIGS. 3, 4 and 5, details of the primary-transfer contact-and-separation mechanism 30 will be described. FIG. 3 is a schematic perspective view (including phase G) showing the primary-transfer contact-and-separation mechanism 30 in this embodiment, FIG. 5 is a schematic perspective view (including phase H) showing the primary-transfer contact-and-separation mechanism 30, and FIG. 5 is a schematic perspective view (including phase L) showing the primary-transfer contact-and-separation mechanism 30. In these FIGS. 3-5, the intermediary transfer belt 12*e* is drawn in a see-through state.

Figure 4:
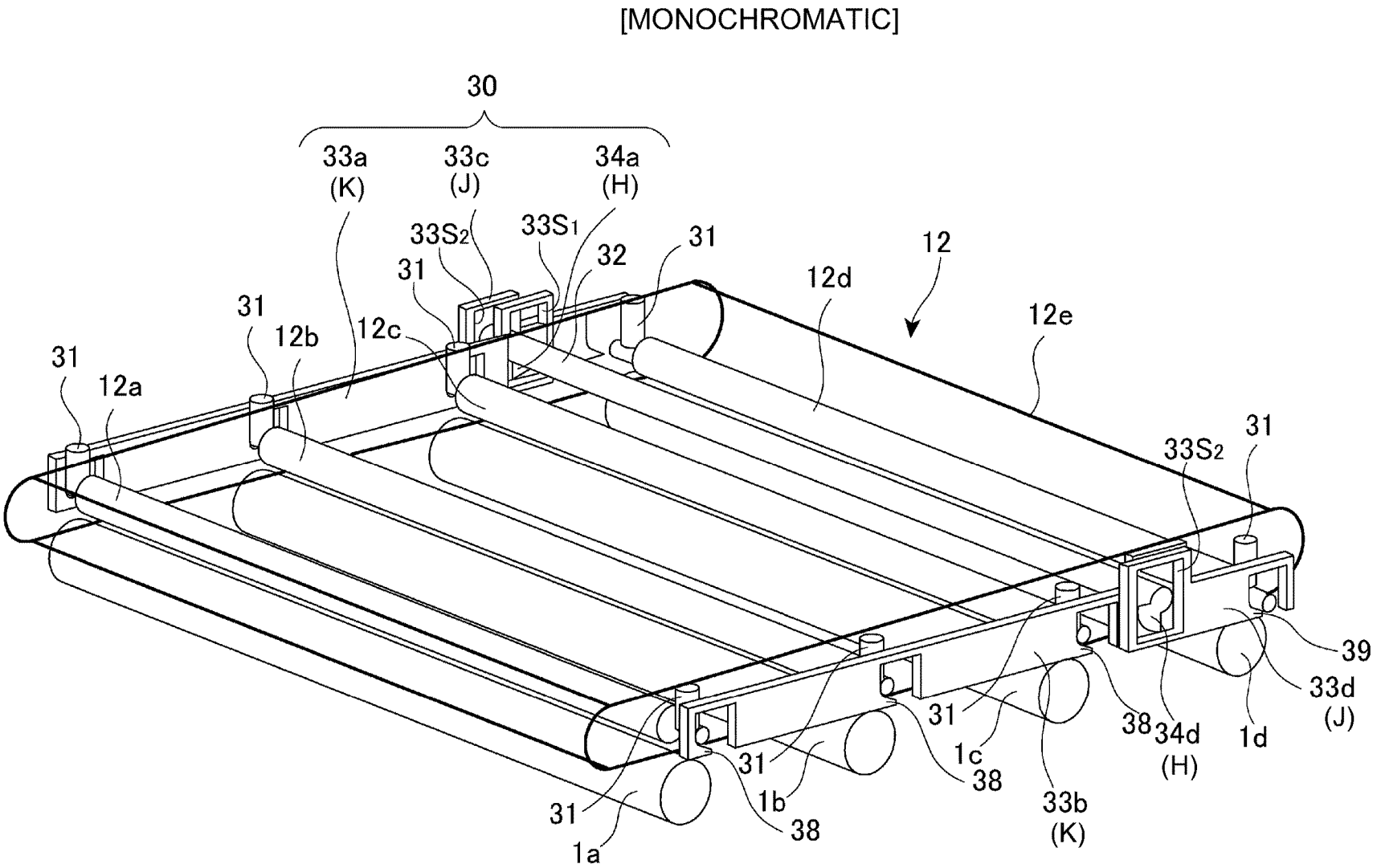
Figure 5:
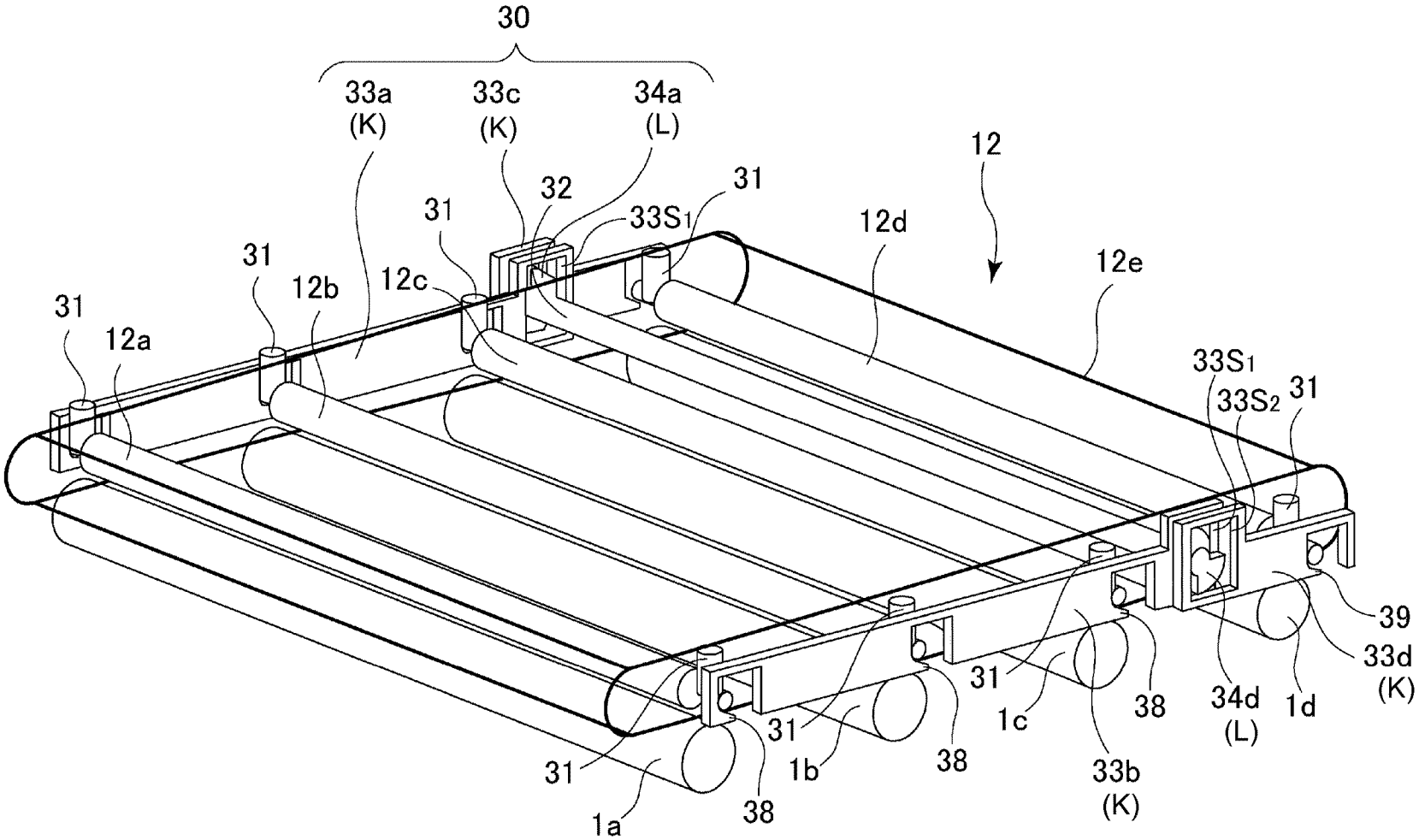
Figure 6:
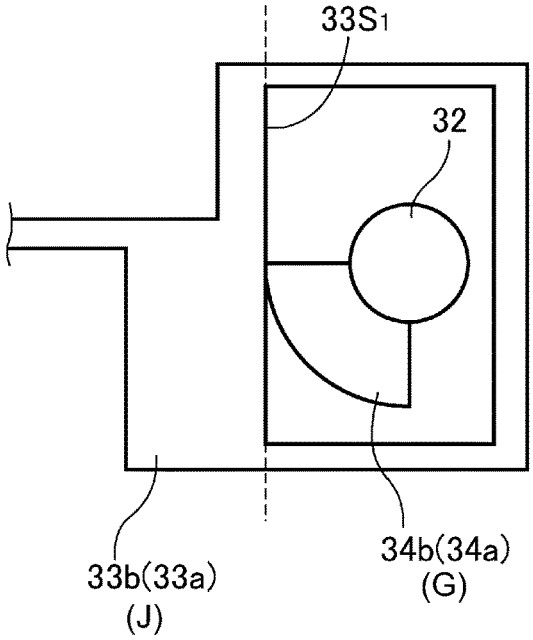
In FIG. 6, (a) and (b) are front views showing a cam member during full-color image formation in First Embodiment.
Figure 6:
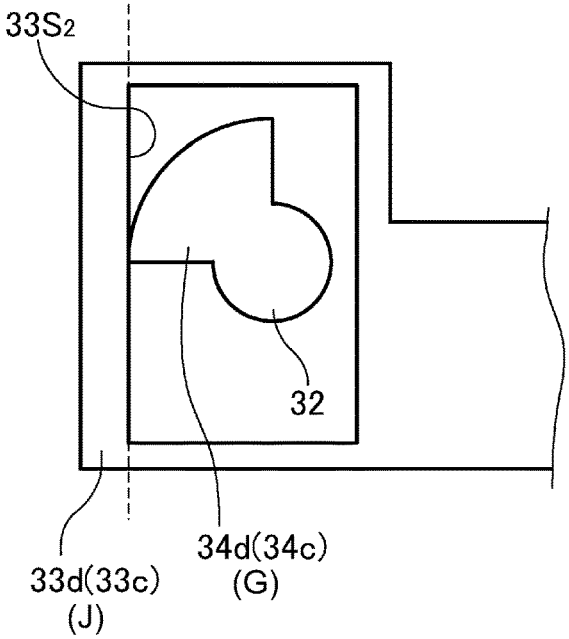

The primary-transfer contact-and-separation mechanism 30 includes, as shown in FIGS. 3-5, slidable members 33*a*, 33*b*, 33*c*, 33*d* and cam members 34*a* and 34*b* ((a) of FIG. 6) and 34*c* and 34*d* ((b) of FIG. 6). As shown in (a) of FIG. 6, (a) of FIG. 7 and (b) of FIG. 8, the cam members 34*a* and 34*b* are fixed at end portions, respectively, of a cam shaft 32 so as to have the same phase in a symmetrical shape. As shown in (b) of FIG. 6, (b) of FIG. 7 and (b) of FIG. 8, the cam members 34*c* and 34*d* are fixed at the end portions, respectively, of the cam shaft 32 so as to have the same phase in a symmetrical shape.

Figure 10:
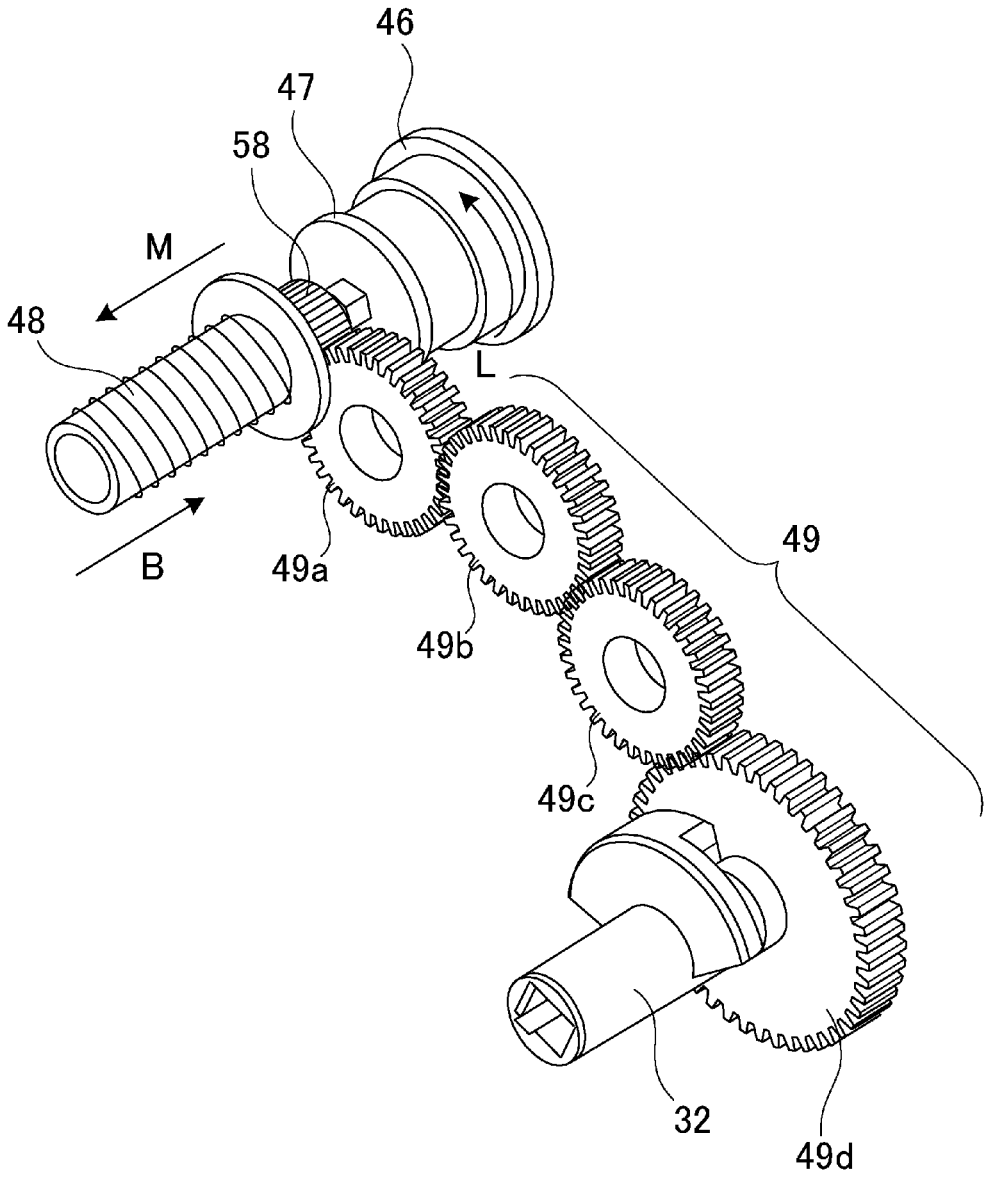
FIG. 10 is a schematic perspective view showing a driven gear train in First Embodiment.

The cam shaft 32 is provided and extended in a widthwise direction of the intermediary transfer belt unit 12 (the intermediary transfer belt 12*e*). To this cam shaft 32, a rotational force is transmitted from the driven coupling 47 via a transmission gear train 49 (FIG. 10). Incidentally, a moving mechanism capable of changing the position of the intermediary transfer belt 12*e* to different three positions relative to the photosensitive drums 1*a*-1*d* by rotational drive of the driving motor 41 is constituted by the cam shaft 32, the cam members (rotatable members) 34*a*-34*d*, the driven coupling 47, the transmission gear train 49 and the like.

As shown in FIGS. 3-5, at the end portions of the primary-transfer rollers 12*a*, 12*b*, 12*c*, the slidable members 33*a* and 33*b* are provided, respectively, and at the end portions of the primary-transfer roller 12*d*, the slidable member 33*c* and 33*d* are provided, respectively. The slidable members 33*a* and 33*b* and the slidable members 33*c* and 33*d* are disposed in parallel with a predetermined interval with respect to the widthwise direction of the intermediary transfer belt 12. Further, each of the slidable members 33*a* and 33*b* and the slidable members 33*c* and 33*d* is supported by an unshown slidable mechanism so as to be movable in a left-right direction in FIG. 3.

The slidable members 33*a* and 33*b* provided in a pair are moved in an arrow Q direction (circumferential direction of the intermediary transfer belt 12*e*) in FIG. 3 by rotation of the cam members 34*a* and 34*b* provided in a pair. The slidable members 33*c* and 33*b* provided in a pair are moved in the arrow Q direction in FIG. 3 by rotation of the cam members 34*c* and 34*d* provided in a pair. Each of the cam members 34*a*, 34*b*, 34*c*, 34*d* is formed in a sector shape extending around the cam shaft 32 having a circular shape in cross-section in a range of 90° with respect to a radial direction. By the movement of the slidable members 33*a*-33*d* in the arrow Q direction, contact-and-separation positions of the primary-transfer rollers 12*a*, 12*b*, 12*c* relative to the photosensitive drums 1*a*, 1*b*, 1*c* and contact-and-separation positions of the primary-transfer roller 12*d* relative to the photosensitive drum 1*d* are changed.

[Operations of Slidable Member and Cam Member]

Next, operations of the slidable members 33*a*-33*d* and the cam members 34*a*-34*d* will be specifically described with reference to FIGS. 3-5, (a) and (b) of FIG. 6, (a) and (b) of FIG. 7 and (a) and (b) of FIG. 8.

Figure 7:
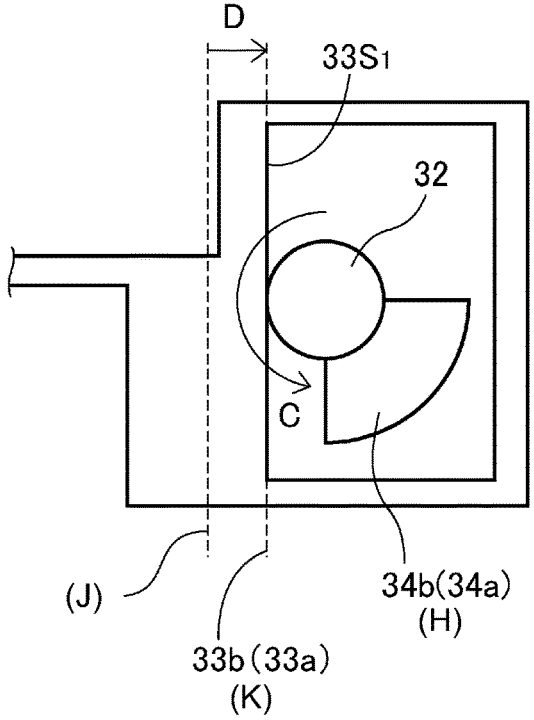
In FIG. 7, (a) and (b) are front views showing the cam member during monochromatic image formation in First Embodiment.
Figure 7:
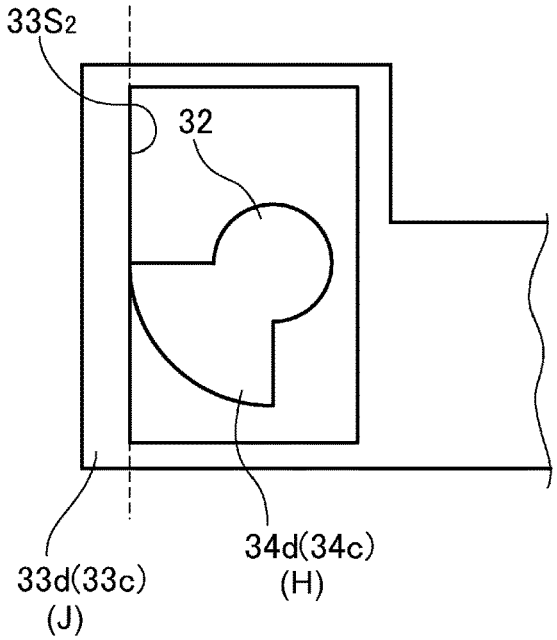
Figure 8:
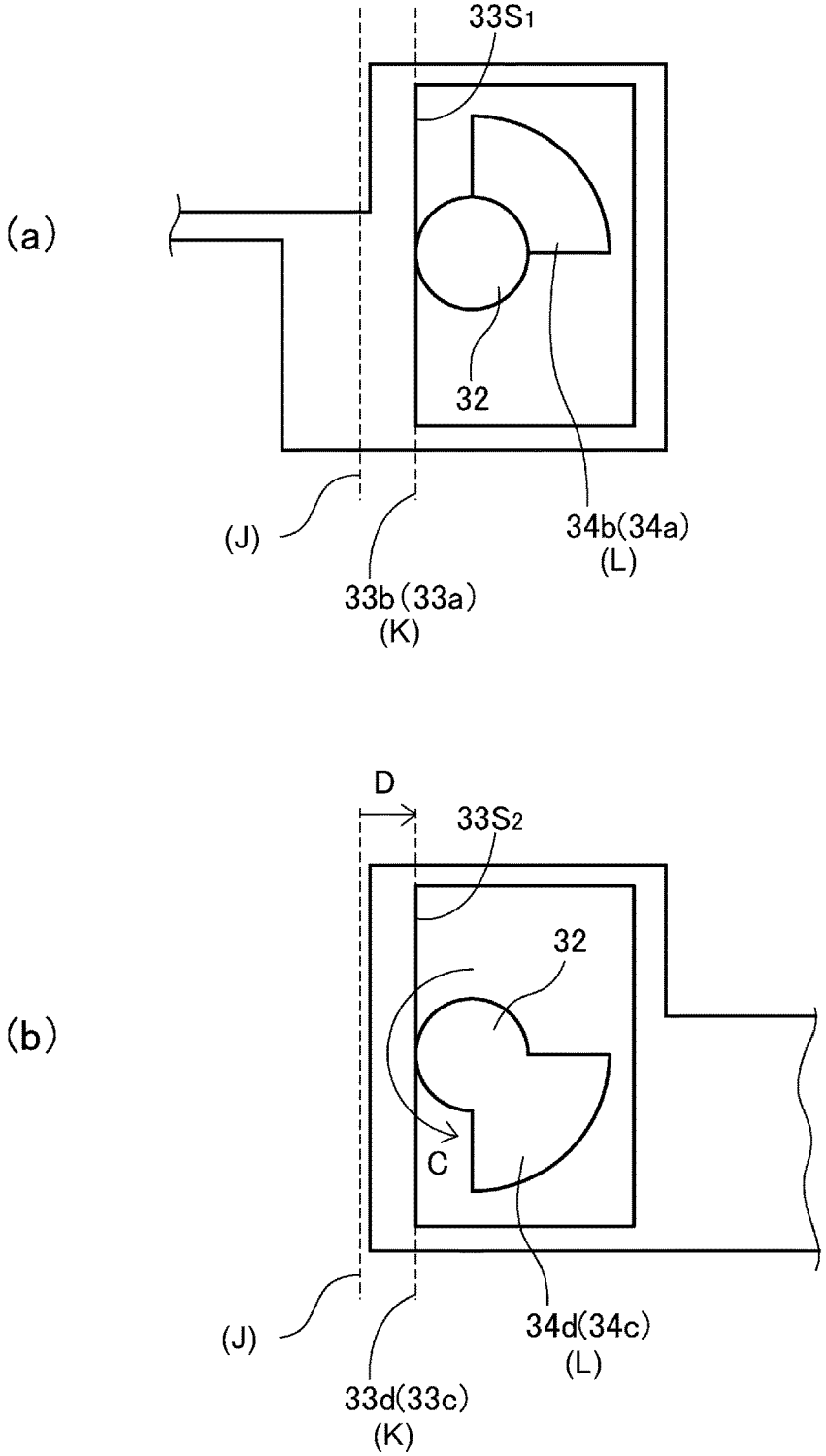
In FIG. 8, (a) and (b) are front views showing the cam member during all separation in First Embodiment.

FIG. 3 corresponds to (a) and (b) of FIG. 6, FIG. 4 corresponds to (a) and (b) of FIG. 7, and FIG. 5 corresponds to (a) and (b) of FIG. 8. In FIG. 6, (a) and (b) are schematic views for illustrating the operations of the cam members 34*a*-34*d* and the slidable members 33*a*-33*d* during the color image formation (full-color mode, all contact position). In FIG. 7, (a) and (b) are schematic views for illustrating the operations of the cam members 34*a*-34*d* and the slidable members 33*a*-33*d* during the monochromatic image formation (monochromatic mode, partial contact position). In FIG. 8, (a) and (b) are schematic views for illustrating the operations of the cam members 34*a*-34*d* and the slidable members 33*a*-33*d* during all separation (all separation mode, all separation position).

In the operation in the full-color mode (all contact position), the intermediary transfer belt (member-to-be-moved) 12*e* is contacted to all the photosensitive drums 1*a*-1*d* which are a plurality of image bearing members. In the operation in the monochromatic mode (partial contact position), the intermediary transfer belt 12*e* is contacted to a part (photosensitive drum 1*d*) of the photosensitive drums 1*a*-1*d*. In the operation in the all separation mode (all separation position), the intermediary transfer belt 12*e* is separated from all the photosensitive drums 1*a*-1*d*. The controller (control means) 45 switches the full-color mode (all contact position), the monochromatic mode (partial contact position) and the all separation mode (all separation position) by drive control of the driving motor (driving motor) 41.

Each of the slidable members 33*a* and 33*b* is provided with an engaging portion $33S_1$ having a rectangular space in which an associated one of the cam members 34*a* and 34*b* is insertable. Further, each of the slidable members 33*c* and 33*d* is provided with an engaging portion $33S_2$ having a rectangular space in which an associated one of the cam members 34*c* and 34*d* is insertable.

Further, the slidable members 33*a* and 33*b* are always urged in the right direction in (a) of FIG. 6 by an unshown urging member so as to follow the rotational operation of the cam members 34*a* and 34*b* inserted in the engaging portion $33S_1$. Further, the slidable members 33*c* and 33*d* are always urged in the right direction in (a) of FIG. 6 by an unshown urging member so as to follow the rotational operation of the cam members 34*c* and 34*d* inserted in the engaging portion 33$S_2$.

[During Full-Color Mode]

During the color image formation, by power transmission from a drive transmitting device 40 described later, to the cam shaft 32, the cam members 34*a*, 34*b* in FIG. 3 are in a state of a phase G shown in (a) of FIG. 6, so that the slidable members 33*a*, 33*b* are held in a state of a position J shown in (a) of FIG. 6. As a result, end portions of each of the primary-transfer rollers 12*a*, 12*b*, 12*c* with respect to an axial direction are released from claw portions 38 of each of the slidable members 33*a*, 33*b*, so that the primary-transfer rollers 12*a*, 12*b*, 12*c* are pressed by using members 31 and thus are contacted to the intermediary transfer belt 12*e* toward the photosensitive drums 1*a*, 1*b*, 1*c*, respectively.

At the same time, the cam members 34*c*, 34*d* in FIG. 3 are in a state of the phase G shown in (b) of FIG. 6 by the rotation of the cam shaft 32, so that the slidable members 33*c*, 33*d* are held in a state of a position J shown in (b) of FIG. 6. As a result, end portions of the primary-transfer roller 12*d* with respect to the axial direction are released from claw portions 39 of the slidable members 33*c*, 33*d*, so that the primary-transfer roller Rd is pressed by the urging member 31 and thus is contacted to the intermediary transfer belt 12*e* toward the photosensitive drum 1*d*.

As described above, during the color image formation, the primary-transfer rollers 12*a*, 12*b*, 12*c*, 12*d* are in an all contact state in which the primary-transfer rollers 12*a*, 12*b*, 12*c*, 12*d* are contacted to the intermediary transfer belt 12*e* toward the photosensitive drums 1*a*, 1*b*, 1*c*, 1*d*, respectively.

[During Monochromatic Mode]

During the monochromatic image formation, by rotation of the cam shaft 32, the cam members 34*a*, 34*b* in FIG. 4 are rotated by 90° in the counterclockwise direction (arrow C direction) in (a) of FIG. 7, and thus are in a state of a phase H shown in the figure, so that the slidable members 33*a*, 33*b* are held in a state of a position K shown in the figure. That is, the engaging portions 33$S_1$ of the slidable members 33*a* and 33*b* follow shapes of the cam members 34*a* and 34*b*, so that each of the slidable members 33*a* and 33*b* moves in an arrow D direction by a predetermined distance.

As a result, end portions of each of the primary-transfer rollers 12*a*, 12*b*, 12*c* for Y, M, C with respect to the axial direction are raised in a separation direction from the photosensitive drums 1*a*, 1*b*, 1*c*, 1*d*, by the claw portions 38 of each of the slidable members 33*a*, 33*b* against the urging force of the urging member 31. For this reason, the primary-transfer rollers 12*a*, 12*b*, 12*c* are held in the separation state from the opposing photosensitive drums 1*a*, 1*b*, 1*c*, respectively.

At the same time, the cam members 34*c*, 34*d* in FIG. 4 are in a state of the phase H shown in (b) of FIG. 7 by the rotation of the cam shaft 32, but each of the cam members 34*c*, 34*d* follow the engaging portion 33$S_1$ at an arcuate end of the sector-shaped portion thereof. For this reason, the slidable members 33*c*, 33*d* are moved in the arrow D direction and thus are held in the state of the same position J as in (a) of FIG. 6. As a result, the primary-transfer roller 12*d* corresponding to Bk is maintained in the contacted state to the opposing photosensitive drum 1*d*.

As described above, during the monochromatic image formation, the primary-transfer rollers 12*a*, 12*b*, 12*c* are retracted from the inner peripheral surface of the intermediary transfer belt 12*e*, and thus the intermediary transfer belt 12*e* is separated from the photosensitive drums 1*a*, 1*b*, 1*c*, so that the primary-transfer roller 12*d* is in the contacted state to the associated photosensitive drum 1*d*.

[During All Separation Mode]

During the all separation, by rotation of the cam shaft 32, the cam members 34*a*, 34*b* in FIG. 5 and rotated by 90° in the counterclockwise direction in (a) of FIG. 8, the thus are in a state of a phase L shown in the figure, so that the slidable members 33*a*, 33*b* are held in a state of the same position K as in (a) of FIG. 7. That is, the engaging portions 33$S_1$ of the slidable members 33*a* and 33*b* follow shapes of the cam members 34*a* and 34*b*, but each of the cam members 34*a* and 34*b* only follows the engaging portion 33$S_1$ at a portion concentrically with the cam shaft 32.

For this reason, the slidable members 33*c* and 33*d* are held at the same position K as in (a) of FIG. 7 without being moved in the arrow D direction. As a result, the primary-transfer rollers 12*a*, 12*b*, 12*c* corresponding to Y, M, C are held in the separation state from the opposing photosensitive drums 1*a*, 1*b*, 1*c*, similarly as described above.

At the same time, the cam members 34*c*, 34*d* in FIG. 8 are in a state of the phase L shown in (b) of FIG. 8 by the rotation of the cam shaft 32, and therefore, each of the cam members 34*c*, 34*d* is spaced from the engaging portion 33$S_1$ at the arcuate end of the sector-shaped portion thereof and rotates. As a result, the slidable members 33*c*, 33*d* are moved in the arrow D direction and thus are in the position K. For this reason, the primary-transfer roller 12*d* is held in the separated state from the opposing photosensitive drum 1*d*.

As described above, during the all separation, all the primary-transfer rollers 12*a*, 12*b*, 12*c*, 12*d* are retracted from the inner peripheral surface of the intermediary transfer belt 12*e*, and thus the intermediary transfer belt 12*e* is separated from the photosensitive drums 1*a*, 1*b*, 1*c*, 1*d*, so that the primary-transfer rollers 12*a*-12*d* are in the all separation state in which the intermediary transfer belt 12*e* is separated from the photosensitive drums 1*a*-1*d*.

[Drive Transmitting Device Including Driving Coupling]

Figure 9:
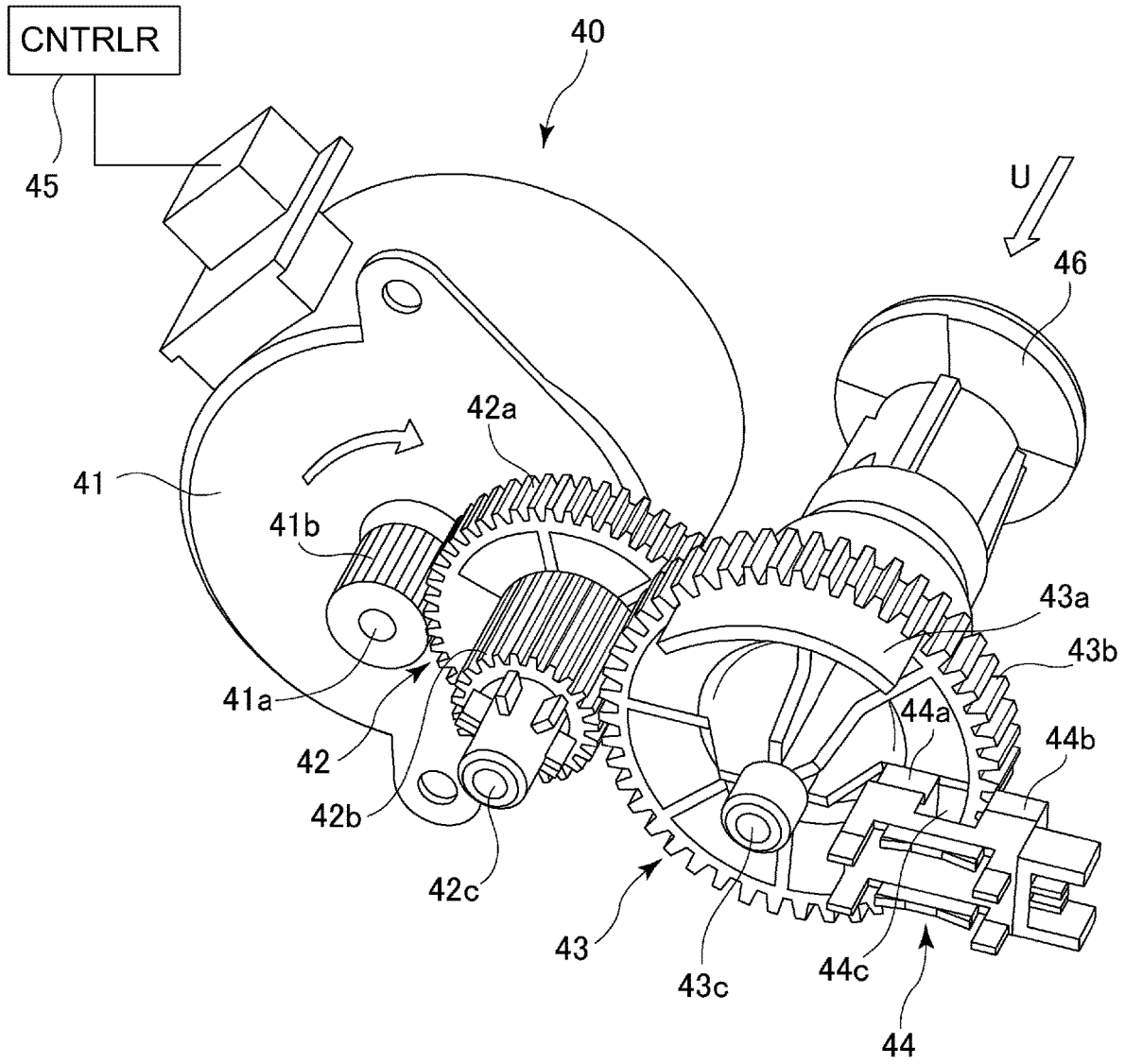
FIG. 9 is a schematic perspective view showing a drive transmitting device in First Embodiment.

Next, with reference to FIG. 9, the drive transmitting device 40 in this embodiment will be specifically described. FIG. 9 is a schematic perspective view showing the drive transmitting device 40 in this embodiment.

As shown in FIG. 9, the drive transmitting device 40 includes the controller 45 as the control means and the driving motor 41 consisting of the pulse motor (stepping motor) or the like driven by control by the controller 45. Further, the drive transmitting device 40 includes a pinion 41*b* fixed to a rotation shaft 41*a* of the driving motor 41. In addition, the drive transmitting device 40 includes a transmitting gear 42 engaging with the pinion 41*b*, a flag gear 43 engaging with the transmitting gear 42, and a sensor 44 for detecting a flag portion (light-blocking portion) 43*a*. Further, the pinion 41*b*, the transmitting gear 42 and the flag gear 43 are supported so that the rotation shaft 41*a*, a rotation shaft 42*c* and a rotation shaft 43*c* are parallel to each other with respect to their axis directions.

Incidentally, the flag portion 43*a* constitutes a flag showing a predetermined rotational position of the driving motor (pulse motor) 41, and the sensor 44 constitutes a detecting portion for detecting the flag portion 43*a*. The flag portion (flag) 43*a* is rotated in synchronism with the position of the intermediary transfer belt (member-to-be-moved) 12*e*, and thus is disposed at a position corresponding to a specific rotation phase range of each of the cam members (rotatable members) 34*a*-34*d* provided in the moving mechanism (32, 34*a*-34*d*, 47, 49).

Further, the controller 45 controls the moving mechanism (32, 34*a*-34*d*, 47, 49) using either one of an operation in a first stop mode an operation in a second stop mode. The first stop mode is a mode in which the moving mechanism is stopped on the basis of detection (result) of the sensor (detecting portion) 44 when the intermediary transfer belt (member-to-be-moved) 12*e* is changed in position (arrangement) of the different three positions (arrangements), from one position (arrangement) to another position (arrangement). The second stop mode is a mode in which the moving mechanism is stopped on the basis of the number of pulses of a driving signal sent to the driving motor (pulse motor) 41.

The controller 45 uses the first stop mode when the intermediary transfer belt (member-to-be-moved) 12*e* is changed in position of the three positions from the second position or the third position to the first position. Further, the controller 45 uses the second stop mode when the intermediary transfer belt position is changed from the first position or the third position to the second position or when the intermediary transfer belt position is charged from the first position or the second position to the third position. The controller 45 controls the moving mechanism (32, 34*a*-34*d*, 47, 49) s that at least the change in position between the second position and the third position is made only by unidirectional rotational drive of the driving motor 41.

Further, the driving coupling 46 is disposed in the apparatus main assembly 50*a* side. In the intermediary transfer belt unit 12, at a position capable of opposing the driving coupling 46 during the mounting and dismounting, the driven coupling 47 (FIG. 10) is disposed. The driving coupling 46 is mounted on the rotation shaft 43*c* of the flag gear 43 so as to be positioned in a side opposite from the gear portion 43*b* with respect to the axial direction.

The transmitting gear 42 is coaxially provided with a large-diameter gear 42*a* engaging with the pinion 41*b* and a small-diameter gear 42*b* smaller in diameter than the large-diameter gear 42*b*. The flag gear 43 includes a large-diameter gear 43*b* engaging with the small-diameter gear 42*b* and the flag portion (light-blocking portion) 43*a* projecting from the gear portion 43*b* in the axial direction so as to extend in an arcuate shape in cross-section. The rotational force of the driving motor 41 is transmitted to the large-diameter gear 42*a* via the pinion 41*b*, so that the transmitting gear 42 is rotated. The rotational force is also transmitted to the gear portion 43*b* via the small-diameter gear 42*b*, s that the driving coupling 46 is rotated together with the flag gear 43 in the same direction.

The sensor 44 is a sensor of a photo-interrupter type in which a light-emitting portion 44*a* and a light-receiving portion 44*b* are provided and in which a detection signal is outputted by switching light, between a light-blocking state and a light-transmission secondary-transfer, blocked in or passed through a gap (spacing) 44*c*, between the light-emitting portion 44*a* and the light-receiving portion 44*b*, in which the flag portion 43*a* moves. When the flag portion 43*a* enters the gap 44*c*, the sensor 44 detects the flag portion 43*a* and then sends a flag ON signal to the controller 45, and when the flag portion 43*a* does not enter the gap 44*c*, the sensor 44 does not detect the flag portion 43*a*.

[Transmitting Gear Train Including Driven Coupling]

In the intermediary transfer belt unit 12 side, as shown in FIG. 10, the driven coupling 47, an urging member 48, and a transmitting gear train 49 for transmitting the rotational force, to the cam shaft 32, transmitted from the driving coupling 46 to the driven coupling 47. This transmitting gear train 49 is constituted by gears 49*a*, 49*b*, 49*c*, 49*d*. The driven coupling 47 connectable to the driving coupling 46 transmits the rotational force thereof to a gear 58 fixed coaxially with the driven coupling 47, and the rotational force of this gear 58 is transmitted, via the transmitting gear train 49, to the cam shaft 32 connected to the gear 49*d*.

The gear 58 is urged in an arrow B direction, i.e., toward the apparatus main assembly 50*a*, by the urging member 48 consisting of a compression coil spring. The driven coupling 47 is disposed so as to oppose the driving coupling 46 in a state in which the intermediary transfer belt unit 12 is mounted in the apparatus main assembly 50*a*.

The driven coupling 47 is pressed into an arrow M direction against the urging member 48 by a pressing force when the intermediary transfer belt unit 2 is guided from the inclined guiding surface 62*a* to the guiding portion 62 during the mounting of the intermediary transfer belt unit 12 into the apparatus main assembly 50*a* (FIG. 2). Then, when the intermediary transfer belt unit 12 is properly mounted, at this time, the driven coupling 47 is released from the guiding portion 62 and is projected by the urging force of the urging member 48, thus engaging with the driving coupling 46. As a result, the driven coupling 47 is rotated by the transmission of the rotational force of the driving motor 41 via the driving coupling 46.

[Positional Relationship Between Flag Portion and Sensor]

Figure 15:
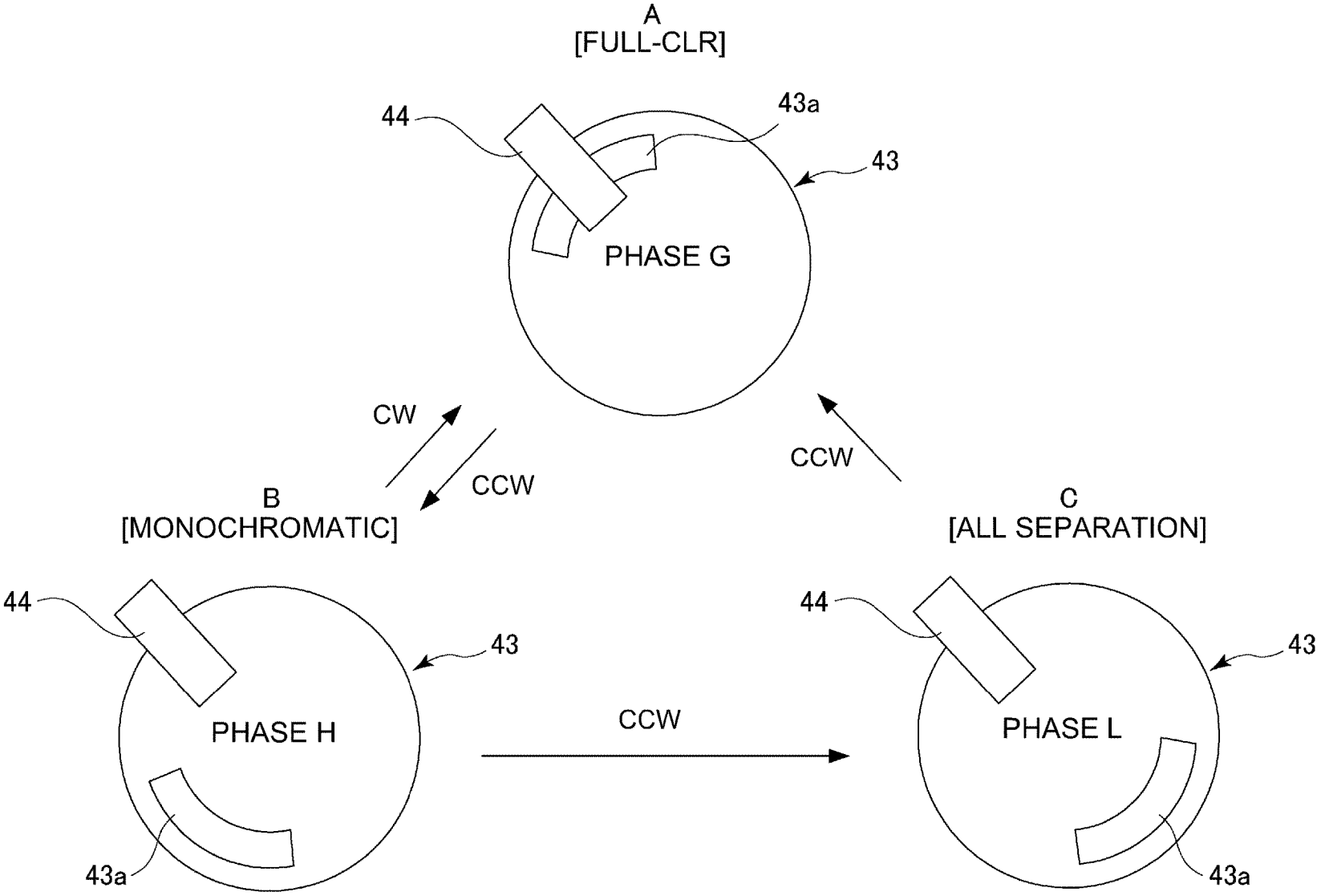
FIG. 15 is a schematic view showing an operation of a flag portion and a sensor of the drive transmitting device in First Embodiment.
Figure 17:
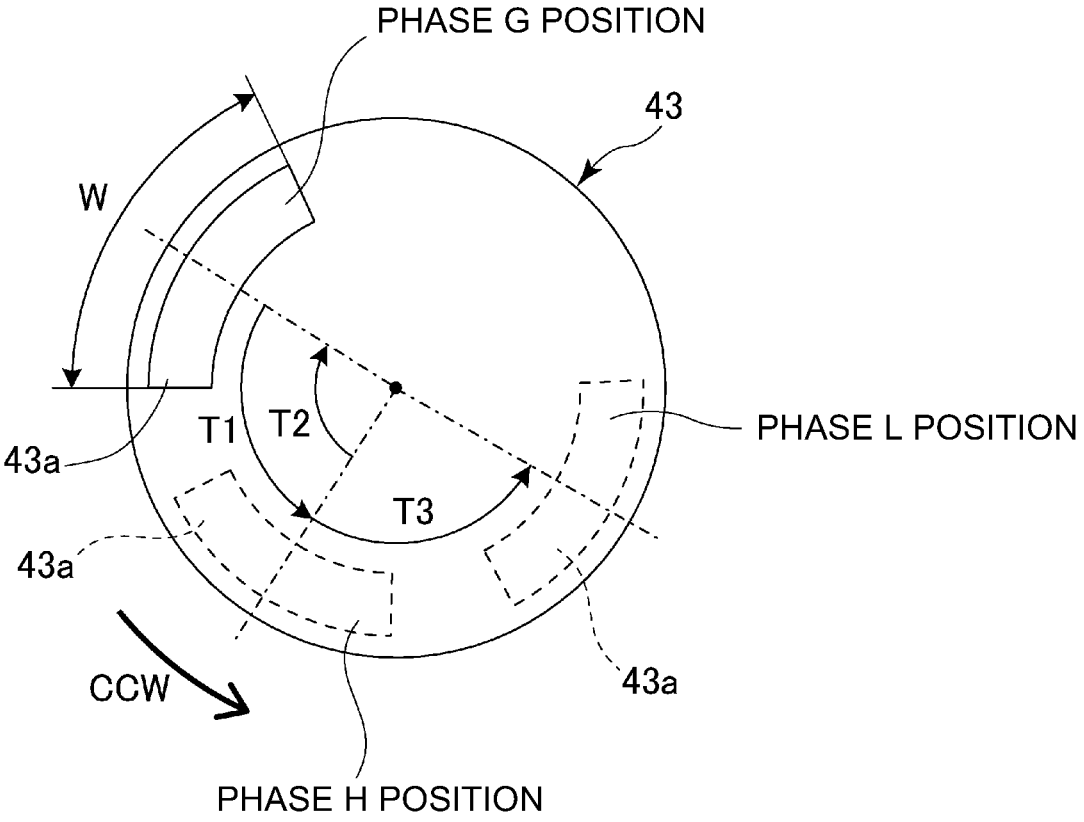
FIG. 17 is a schematic view of a state, as seen in an arrow U direction of FIG. 9, showing a rotational position of a flag gear in First Embodiment.

A positional relationship between the flag portion 43*a* and the sensor 44 will be described with reference to FIGS. 9, 15 and 17. FIG. 15 is a schematic view showing operations each between the flag portion 43*a* and the sensor 44 of the drive transmitting device 40 in this embodiment, and shows a state as seen from an arrow U direction in FIG. 9. FIG. 17 is a schematic view showing a rotational position of the flag gear 43 in this embodiment, and shows a state as seen from the arrow U direction in FIG. 9.

In FIG. 15, an indicated symbol "A" represents a positional relationship between the flag portion 43*a* and the sensor 44 during the operation in the full-color mode (color image formation). This state "A" corresponds to the phase G (FIG. 3 and (a) and (b) of FIG. 6) of the cam members 34*a*-34*d* in the primary-transfer contact-and-separation mechanism 30. At this time, in the intermediary transfer belt unit 12, as shown in FIGS. 3 and 6, each of the cam members 34*a*, 34*b* and the cam members 34*c*, 34*d* is in the phase G, and therefore each of the slidable members 33*a*, 33*b* and the slidable members 33*c*, 33*d* is held at the position J.

In FIG. 17, the flag portion 43*a* of the flag gear 43 is in the phase G indicated by a solid line, and a width (arcuate length) with respect to a circumferential direction is W. In the case where the arcuate length of the flag portion 43*a* is W, when the flag portion 43*a* is rotated in the counterclockwise direction (CCW direction) in FIG. 17 by the drive of the driving motor 41, a time required to rotate the flag portion 43*a* from the phase G to the phase H is T1. Further, when the flag portion 43*a* is rotated in the clockwise direction (CW direction) in FIG. 17 by the drive of the driving motor 41, a time required to rotate the flag portion 43*a* from the phase H to the phase G is T2. Further, when the flag portion 43*a* is rotated in the counterclockwise direction (CCW direction) in FIG. 17 by the drive of the driving motor 41, a time required to rotate the flag portion 43*a* from the phase H to the phase L is T3.

From the above state "A", when the flag gear 43 is rotated in the counterclockwise direction (CCW direction) by further rotation of the driving motor 41, the state is changed to a state indicated by a symbol "B" in FIG. 15. This state "B" corresponds to the phase H (FIG. 4 and (a) and (b) of FIG. 7) of the cam members 34*a*-34*d* in the primary-transfer contact-and-separation mechanism 30. In FIG. 17, the flag portion 43*a* moves to the phase H indicated by a broken line by advance of the time T1 with respect to a center of the arcuate length W.

In this case, in the intermediary transfer belt unit 12, as shown in FIGS. 4 and 7, the cam members 34*a*, 34*b* and the cam members 34*c*, 34*d* is in the phase H. However, as described above, the slidable members 33*a*, 33*b* move to the position K, but the slidable members 33*c*, 33*d* remain at the position J. As a result, the intermediary transfer belt unit 12 is in the state of the monochromatic mode (Bk single-color mode).

From the above state "B", when the flag gear 43 is rotated in the counterclockwise direction (CCW direction) by further rotation of the driving motor 41, the state is changed to a state indicated by a symbol "C" in FIG. 15. This state "C" corresponds to the phase L (FIG. 5 and (a) and (b) of FIG. 7) of the cam members 34*a*-34*d* in the primary-transfer contact-and-separation mechanism 30. In FIG. 17, the flag portion 43*a* moves to the phase L indicated by a broken line by advance of the time T3 from the phase H with respect to a center of the arcuate length W.

In this case, in the intermediary transfer belt unit 12, as shown in FIGS. 5 and 8, the cam members 34*a*, 34*b* and the cam members 34*c*, 34*d* is in the phase L, and as described above, the slidable members 33*a*, 33*b* remain at the position K, but the slidable members 33*c*, 33*d* move to the position J. As a result, the intermediary transfer belt unit 12 is in the state of the all separation mode.

Figure 18:
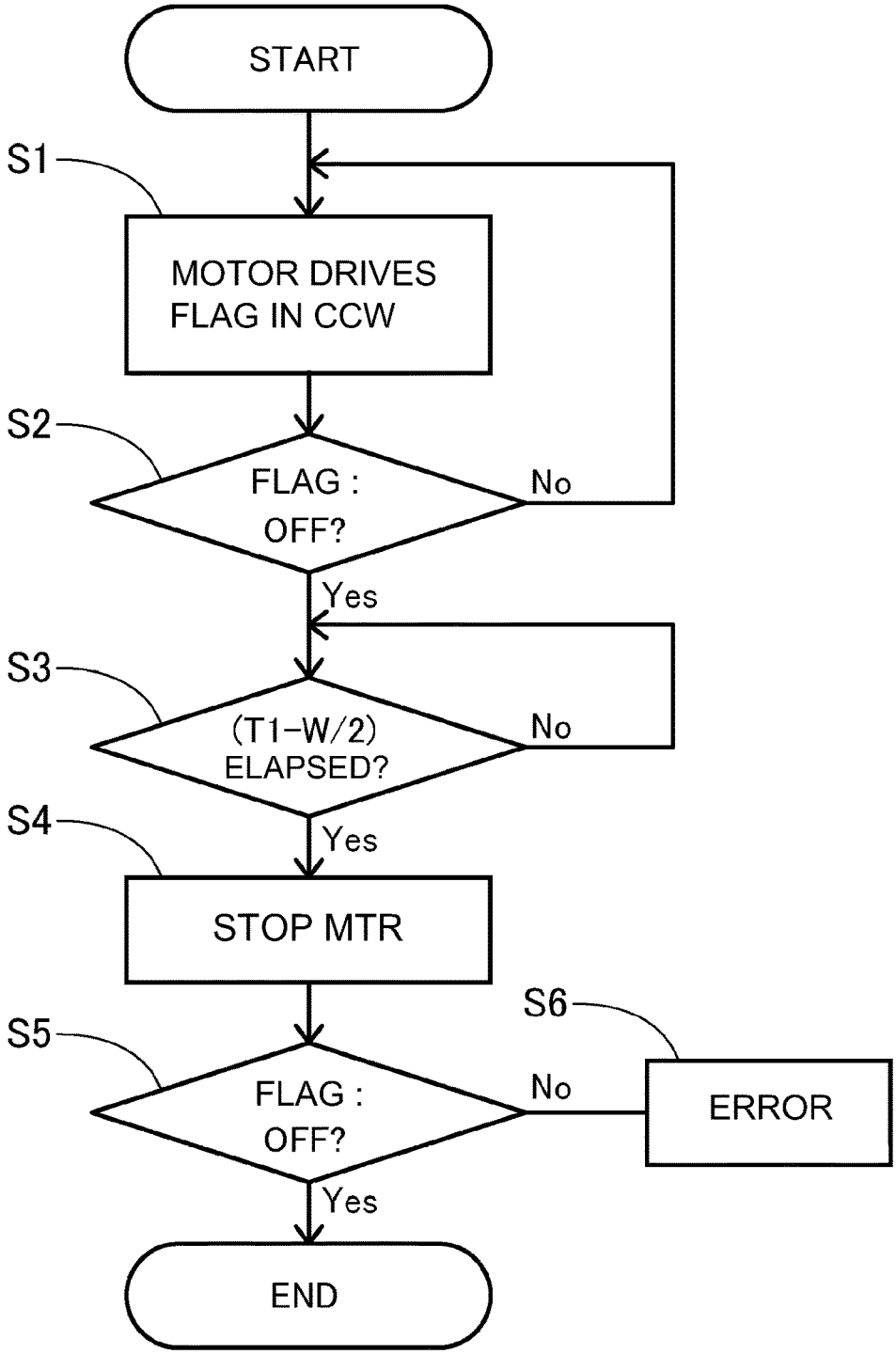
FIG. 18 is a flowchart showing a control flow of switching from a full-color mode to a monochromatic mode.

Next, a switching operation from the full-color mode to the monochromatic mode will be described with reference to FIGS. 15, 17 and 18. FIG. 18 is a flowchart showing a contact flow of switching from the full-color mode to the monochromatic mode.

First, the driving motor 41 responsive to the control by the controller 45 drives the flag portion 43*a* so as to rotate in the counterclockwise direction (CCW direction) in FIG. 17 (step S1). On the basis of output of a flag OFF signal by movement of the flag portion 43*a* into the gap 44*c*, when the controller 45 detects the flag OFF signal (S2: Yes), the controller 45 awaits a lapse of a time of (T1−W/2) (S3: Yes), and then stops the driving motor 41 (S4).

Then, the controller 45 discriminates, on the basis of the detection of the sensor 44, whether or not the flag OFF signal is outputted (S5), and when the flag OFF signal is outputted (S5: Yes), ends a process, and when the flag OFF signal is not outputted (S5: No), discriminates that an error occurs (S6). During the occurrence of the error, e.g., at an operating portion (not shown) provided on the apparatus main assembly 50*a*, a massage such as "PLEASE CONTACT SERVICE PERSON" is displayed together with an arrow code (number in a plurality digits), so that it is possible to stop the operation of the apparatus main assembly 50*a*.

Figure 19:
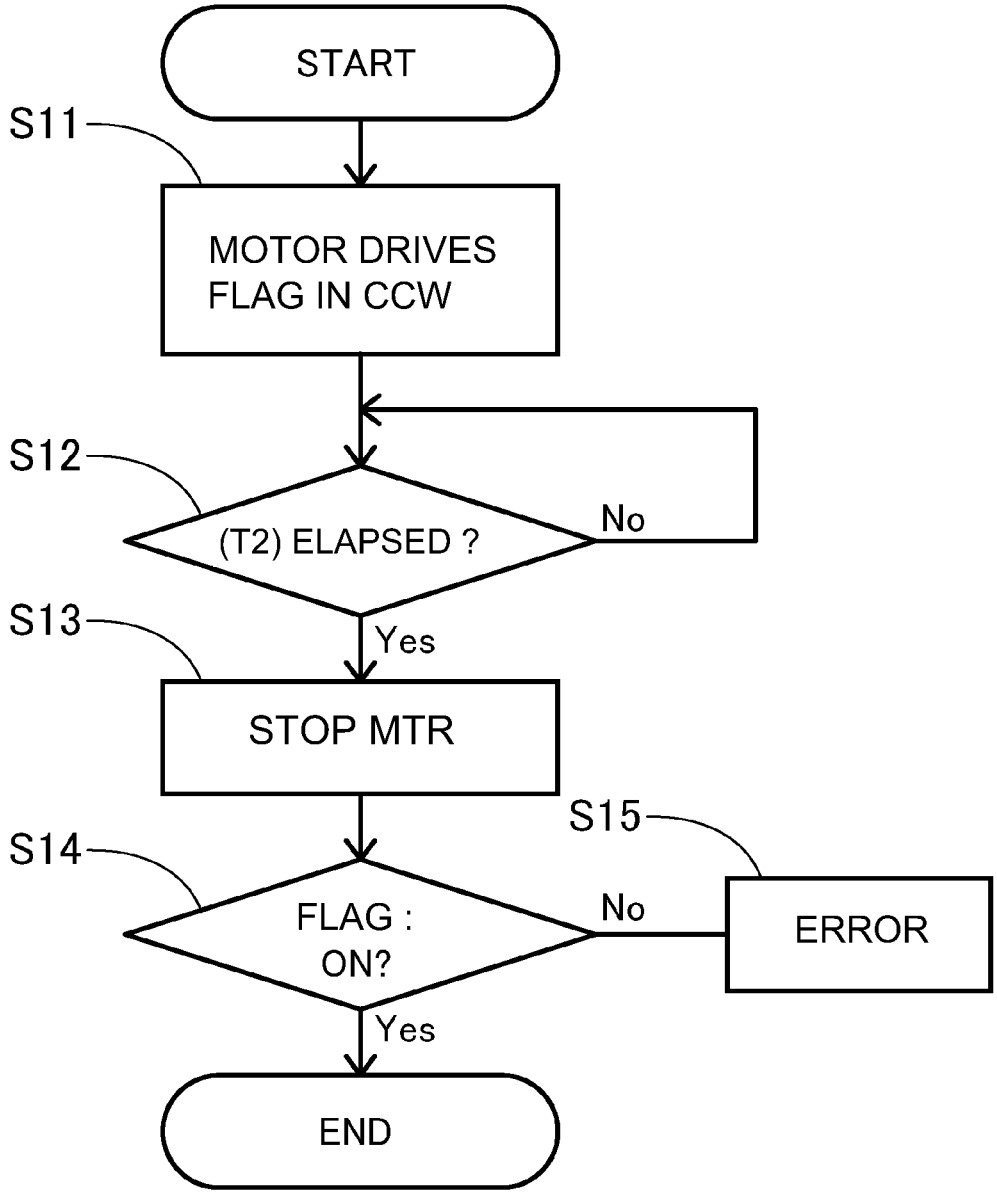
FIG. 19 is a flowchart showing a control flow of switching from the monochromatic mode to the full-color mode.

Next, a switching operation from the monochromatic mode to the full-color mode will be described with reference to FIGS. 15, 17 and 19. FIG. 19 is a flowchart showing a contact flow of switching from the monochromatic mode to the full-color mode.

First, the driving motor 41 responsive to the control by the controller 45 drives the flag portion 43*a* so as to rotate in the counterclockwise direction (CW direction) in FIG. 17 (S11). Then, the controller 45 awaits a lapse of a time of T2 (S12: Yes), and then stops the driving motor 41 (S13) and then the flag portion 43*a* enters the gap 44*c*, and the controller 45 checks the flag ON signal (S14).

Then, the controller 45 ends a process when the flag OFF signal is outputted (S14: Yes), and discriminates that an error occurs (S15) when no flag OFF signal (S14: No) is outputted.

Figure 20:
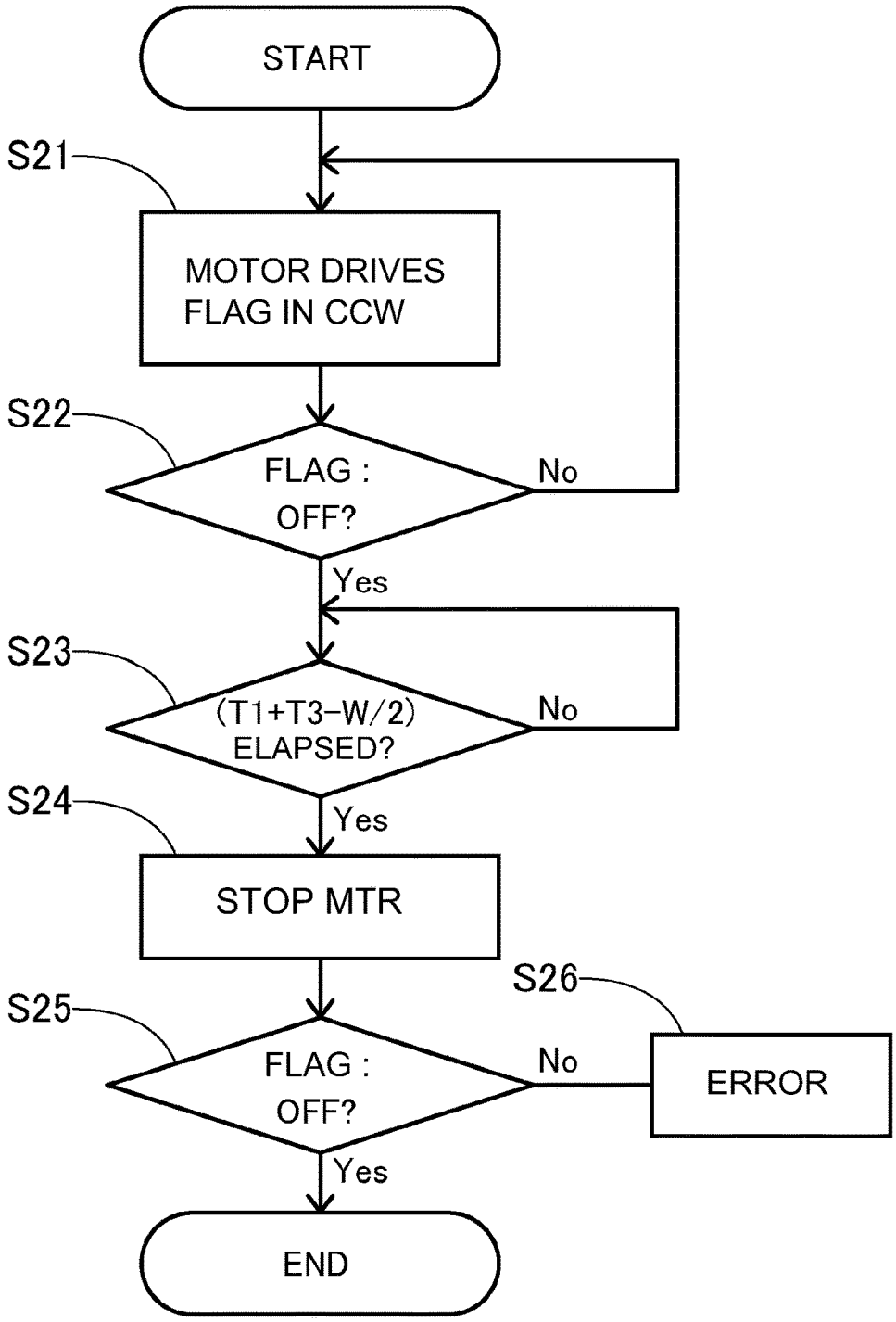
FIG. 20 is a flowchart showing a control flow of switching from the full-color mode to an all separation mode.

Next, a switching operation from the full-color mode to the all separation mode will be described with reference to FIGS. 15, 17 and 20. FIG. 20 is a flowchart showing a contact flow of switching from the full-color mode to the all separation mode.

First, the driving motor 41 drives the flag portion 43*a* so as to rotate in the counterclockwise direction (CCW direction) in FIG. 17 in response to the control by the controller 45 (step S21). Next, when the controller 45 detects the flag OFF signal (S22: Yes), the controller 45 awaits a lapse of a time of (T1+T3−W/2) (S23: Yes), and then stops the driving motor 41 (S24) and checks the flag OFF signal (S25). Then, the controller 45 ends a process when the flag OFF signal is outputted (S25: Yes) and discriminates that an error occurs (S26) when no flag OFF signal (S25: No) is outputted.

As described above, the controller in this embodiment controls the three positions of the intermediary transfer belt 12*e* as the member-to-be-moved to be moved via the primary-transfer rollers 12*a*-12*d* in the following manner. That is, the different three positions (arrangements) are the all contact position (arrangement), the partial contact position (arrangement) and the all separation position (arrangement). As described above, the all contact position is a position where all the photosensitive drums 1*a*-1*d* and the intermediary transfer belt 12*e* contact each other. The partial contact position is a position where a part (1*d*) of the photosensitive drums 1*a*-1*d* and the intermediary transfer belt 12*e* contact each other. The all separation position is a position where all the photosensitive drums 1*a*-1*d* and the intermediary transfer belt 12 are separated from each other.

The controller 45 effects the following control when the first position (e.g., the all contact position (full-color mode) is based on detection of the flag portion 43*a* by the sensor 44, and the second and third positions are based on the pulse number of the driving signal without detecting the flag portion 43*a* by the sensor 44. That is, the controller 45 controls the moving mechanism so that a change in position at least between the second position (e.g., the partial contact position (monochromatic mode)), and the third position (e.g., the all separation position (all separation mode)) is only unidirectional rotational drive (FIG. 15).

In other words, the above three positions are the first position (e.g., the state "A" in FIG. 15), the second position (e.g., the state "B" in FIG. 15), and the third position (e.g., the state "C" in FIG. 15). The first position is the position on the basis of the detection of the flag portion 43*a* by the sensor 44, and the second position and the third position are the positions on the basis of the pulse number of the driving signal sent to the driving motor 41 without detecting the flag portion 43*a* by the sensor 44. In this case, the controller 45 effects control so that the movement at least between the second position and the third position is made only by unidirectional rotation of the driving motor 41. As a result, prolongation of a mode switching time and a device rise time is avoided and at the same time, productivity is enhanced by suppressing prolongation of downtime, so that it becomes possible to prevent an occurrence of problems such as a user stress, shortening of lifetime of the apparatus.

The controller 45 makes the change in position of the intermediary transfer belt 12*e* between the first position (e.g., the state "A") and the second position (e.g., the state "B") by bi-directional rotation of the driving motor 41. Further, the controller 45 effects control so that the change in position between the first position and the third position (e.g., the state "C") is by the unidirectional rotation of the driving motor 41. As a result, the state transfer in the order of the state "A", the state "B" and the state "C" can be made only by the unidirectional rotation (in the counterclockwise direction) of the driving motor 41, and therefore it is possible to contribute to backlash elimination such that so-called backlash of the gears or the like from the driving motor 41 to the cam shaft 32 is eliminated.

Figure 16:
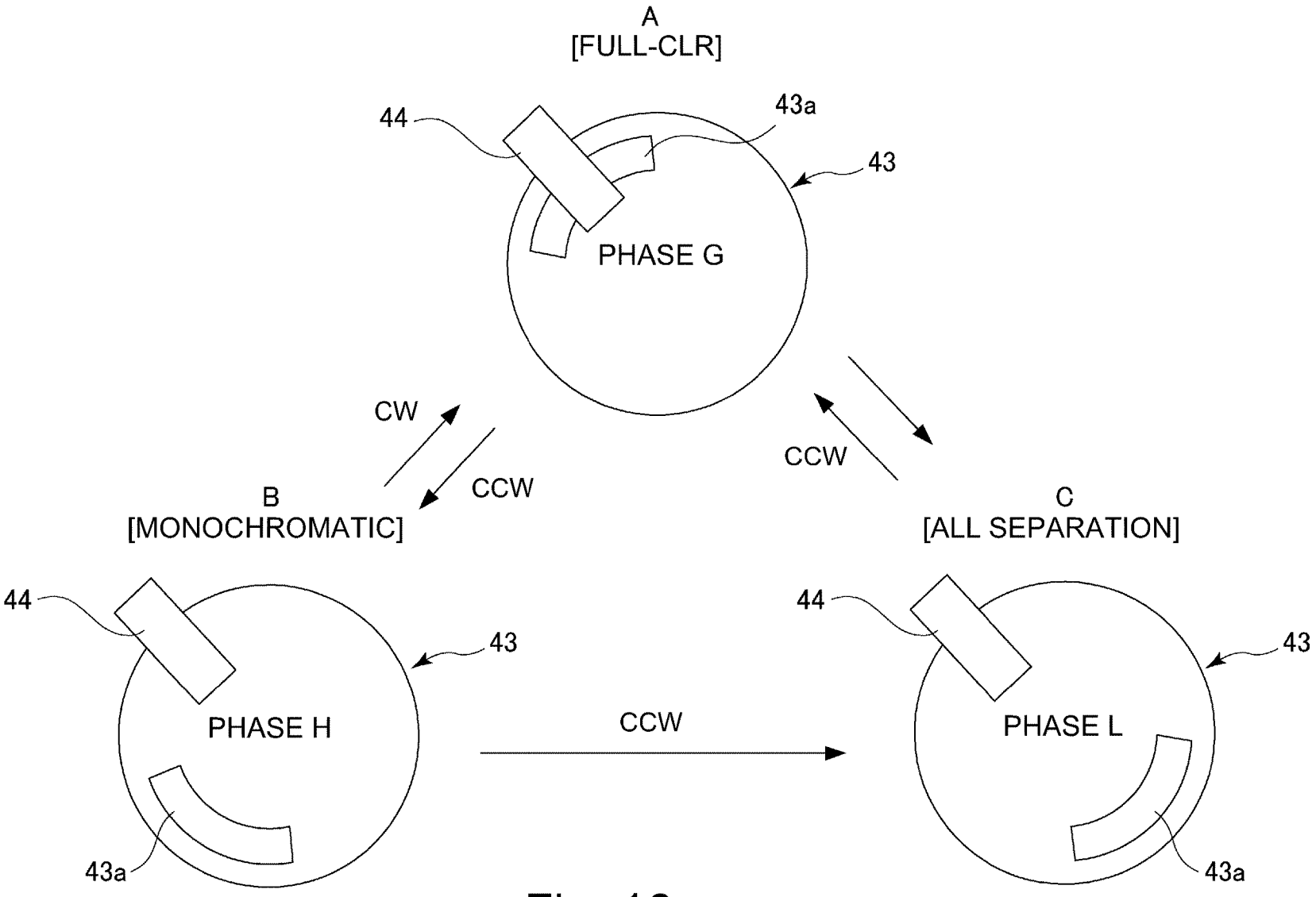
FIG. 16 is a schematic view showing another operation of the flag portion and the sensor of the drive transmitting device in First Embodiment.

Alternatively, the control by the controller 45 is partly changed, whereby it is also possible to carry out the control as shown in FIG. 16. That is, the control is effected so that the change in position of the intermediary transfer belt 12*e* between the first position and the second position is made by the bi-directional rotation of the driving motor 41 and also the change between the first position and the third position is made by the bi-directional rotation of the driving motor 41. In this case, an effect with respect to the backlash elimination as described above is somewhat decreased, but the effects such that the prolongation of the mode switching time and the apparatus rise time and the enhancement in productivity by the suppression of the downtime prolongation can be similarly obtained.

[Drive-Connecting Mechanism During Mounting and Dismounting of Intermediary Transfer Belt Unit]

Figure 11:
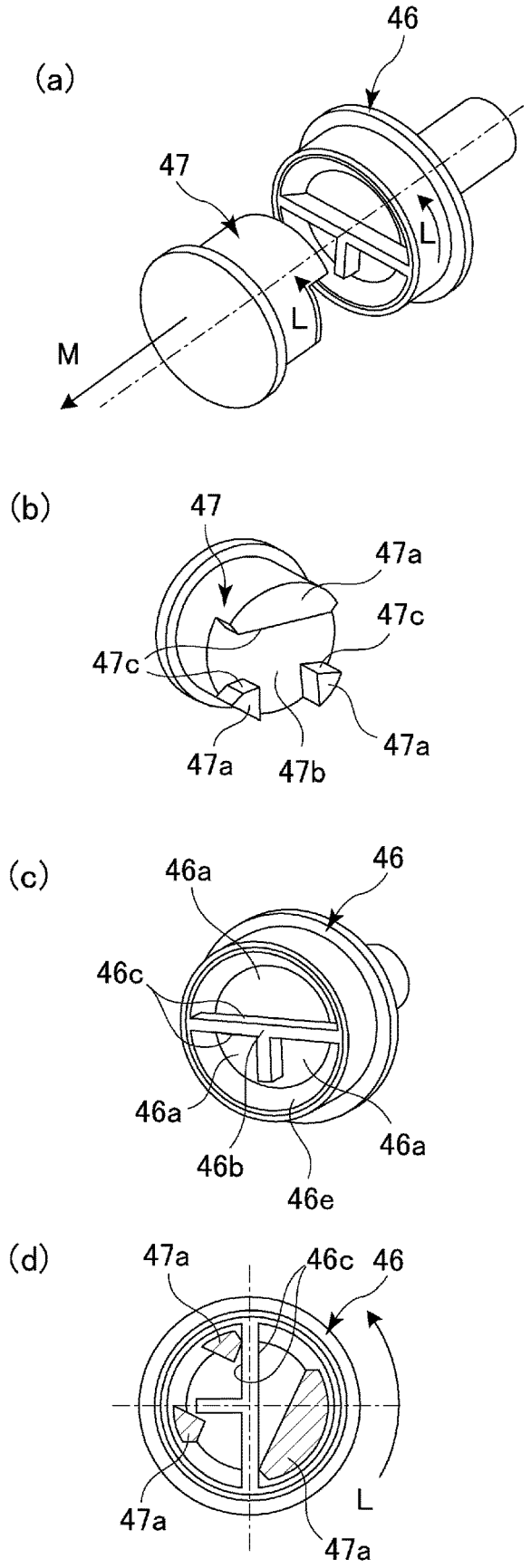
In FIG. 11, (a) to (d) are schematic views showing a coupling portion.

Next, with reference to FIGS. 11-14, the coupling portion used when the intermediary transfer belt unit 12 is mounted into and dismounted from the apparatus main assembly 50*a* will be described. In FIG. 11, (a) to (d) are schematic views showing the coupling portion.

The intermediary transfer belt 12*e* is constituted so as to be mountable into and dismountable from the apparatus main assembly 50*a* at the all separation position during the operation in the all separation mode by the mounting and dismounting of the intermediary transfer belt 12 relative to the apparatus main assembly 50*a*. In this apparatus main assembly side, the above-described driving motor (pulse motor) 41 is provided. Further, the coupling portion which is provided connectably and separably between the driving motor 41 and the intermediary transfer belt 12*e* and which is capable of transmitting power between the driving motor 41 and the intermediary transfer belt 12*e* in a connected state is provided.

That is, the intermediary transfer belt unit 12 includes the intermediary transfer belt 12*e* and the moving mechanism (32, 34*a*-34*d*, 47, 49) and is disposed so as to be mountable in and dismountable from the apparatus main assembly 50*a*. The coupling portion is provided between the driving motor 41 provided in the apparatus main assembly 50*a* side and the moving mechanism, and when the position of the intermediary transfer belt 12*e* relative to the photosensitive drums 1*a*-1*d* is the all detection position, enables switching between transmission and elimination of power between the driving motor 41 and the moving mechanism.

This coupling portion includes, as shown in FIG. 10 and FIGS. 11-14, the driving coupling 46 and the driven coupling 47 which are connectable and separable at the all separation position. As a result, only by moving the intermediary transfer belt unit 12 in an inserting and pulling-out direction along the guiding portion 62 (FIG. 2) provided in the apparatus main assembly 50*a* side, this belt unit 12 can be dismounted from and mounted in the apparatus main assembly 50*a* very simply and with reliability.

That is, the driving coupling 46 and the driven coupling 47 are, as shown in (a) of FIG. 11, constituted as cylindrical members such that the driving coupling 46 is somewhat larger in diameter than the driven coupling 47 so that the couplings are engageable with each other in an opposed state.

In an engaged state between the driving coupling 46 and the driven coupling 47 shown in FIG. 10, a second engaging portion 47*a* of the driven coupling 47 shown in FIG. 11 contacts an inclined surface 46*e* ((c) of FIG. 11) provided at an inner periphery of the driving coupling 46. For that reason, when the intermediary transfer belt unit 12 is pulled out from the apparatus main assembly 50*a*, a pulling-out force acts on the intermediary transfer belt unit 12 in the mounting and dismounting direction (the arrow A direction in FIG. 12, the arrow R direction in FIG. 2), so that the second engaging portion 47*a* slides on the inclined surface 46*e*.

As a result, a force for moving the driven coupling 47 in an arrow M direction opposite to an urging direction (the arrow B direction in FIG. 10) by an urging member 48 acts on the driven coupling 47. For this reason, the driven coupling 47 temporarily retracts from the driving coupling 46 in the arrow M direction, and when engagement between the first engaging portion 46*b* and the second engaging portion 47*a* is eliminated, it is possible to pull out the intermediary transfer belt unit 12 from the apparatus main assembly 50*a*.

As shown in (c) of FIG. 11, in the inner periphery side of the inclined surface 46*e* in the driving coupling 46, the first engaging portion 46*b* is formed so as to project in "T-shape" from a bottom 46*a* formed in a flat shape. On the other hand, as shown in (b) of FIG. 11, in a side where the driven coupling 47 opposes the driving coupling 46, the second engaging portion 47*a* engageable so as to sandwich the T-shaped first engaging portion 46*b* from above, below, left and right is formed so as to project from an edge portion of a flat surface 47*b*. Further, as shown in (d) of FIG. 11, when the driving coupling 46 is rotated in, e.g., an arrow L direction, the contact surface 46*c* of the T-shaped first engaging portion 46*b* rotates the driven coupling 47 in the same direction via the second engaging portion 47*a* while engaging with the second engaging portion 47*a*.

Figure 12:
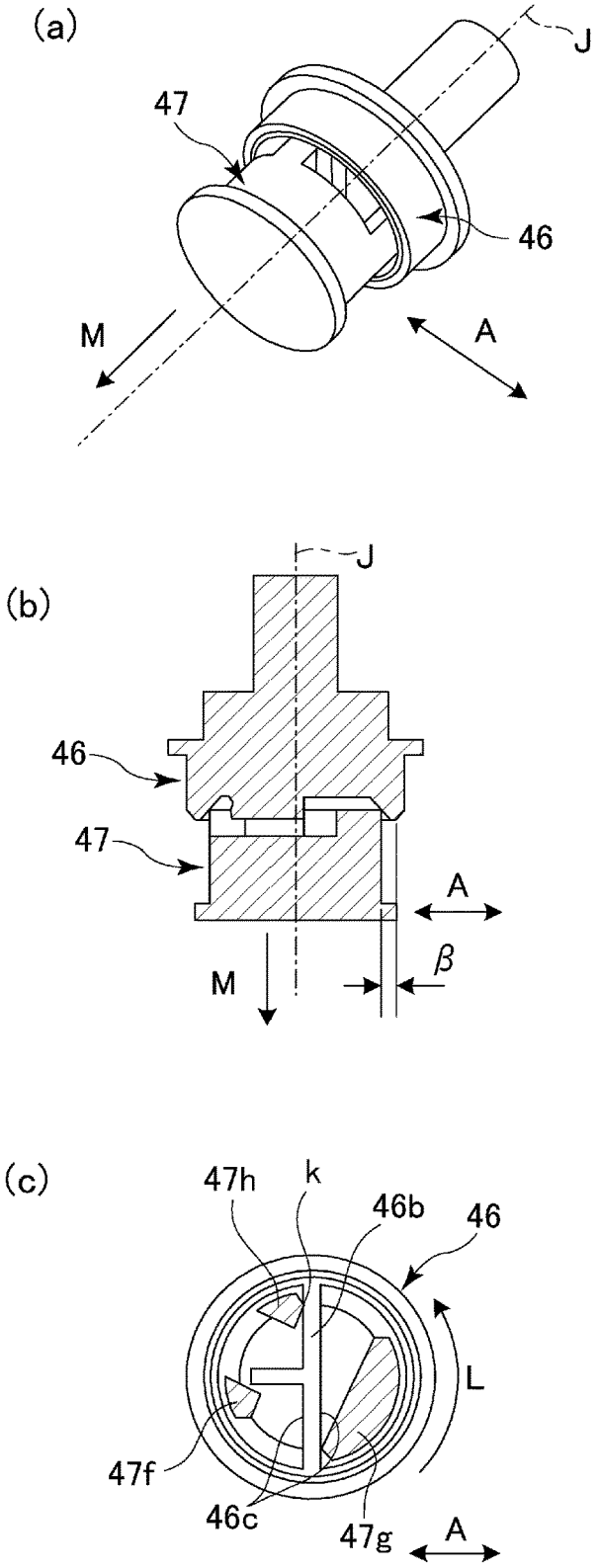
In FIG. 12, (a) to (c) are schematic views showing a state of the coupling portion before disengagement of the intermediary transfer belt unit starts.
Figure 13:
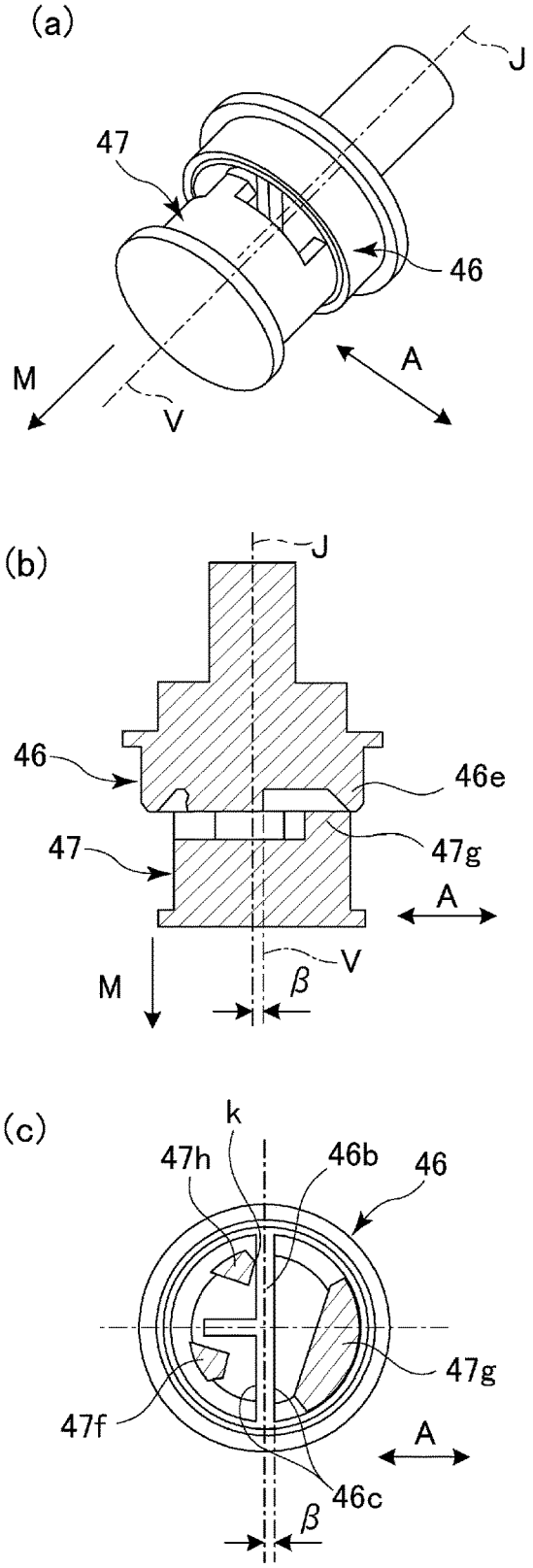
In FIG. 13, (a) to (c) are schematic views showing a contact-eliminated state between first and second engaging portions of the coupling portion.
Figure 14:
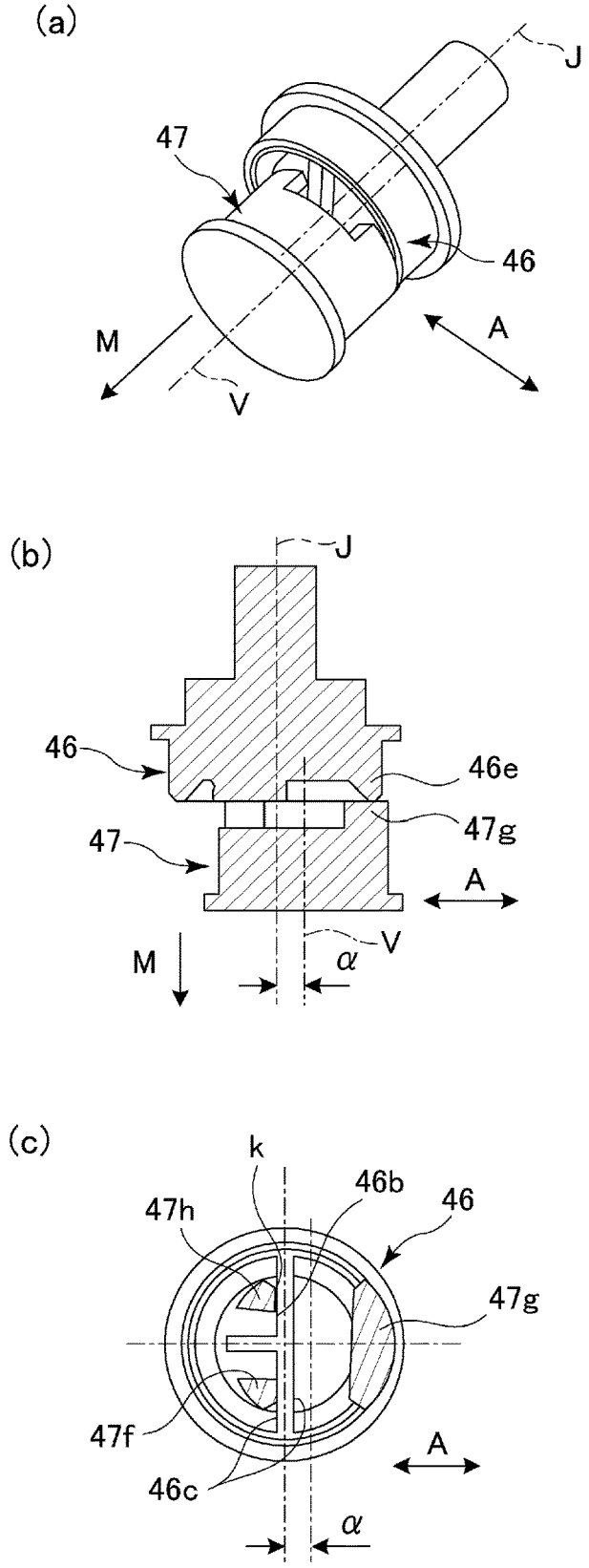
In FIG. 14, (a) to (c) are schematic views showing a distance between rotation shafts of the coupling portions.

The coupling portion will be described below further specifically with reference to FIGS. 12 and 13. In FIG. 12, (a) to (c) are schematic views showing a state of the coupling portion before disengagement of the intermediary transfer belt unit 12 starts. In FIG. 13, (a) to (c) are schematic views showing a state in which the contact between the first and second engaging portions of the coupling portion is eliminated. In FIG. 14, (a) to (c) are schematic views showing a distance between rotation shafts of the coupling portion.

In each of FIGS. 12 and 13, (a) shows a state of engagement between the driving coupling 46 and the driven coupling 47. Further, (b) of FIG. 12 and (b) of FIG. 13 are sectional views each showing the engagement state between the driving coupling 46 and the driven coupling 47 as seen from a direction perpendicular to the rotation shaft. Further, (c) of FIG. 12 and (c) of FIG. 13 are schematic views each showing the engagement state between the driving coupling 46 and the driven coupling 47 as seen from a rotational axis direction.

In a state before the intermediary transfer belt unit 12 is disengaged from the apparatus main assembly 50*a*, the engagement state is as shown in (b) of FIG. 12. That is, of the three second engaging portions 47*a*, between the second engaging portion positioned in an upstreammost side with respect to an intermediary transfer belt unit disengagement direction (hereinafter this second engaging portion is referred to as a second engaging portion 47*f*) and the contact surface 46*c* of the first engaging portion 46*b*, a sufficient gap is created with respect to the rotational direction. This is because at this time, the flag gear 43 is in the state of the phase L (FIGS. 5 and 8), and as described above, the transfer to the phase L is always made only by the rotation from the phase H in the CCW direction (FIGS. 15 and 16).

When the intermediary transfer belt unit 12 is pulled out from the apparatus main assembly 50*a* in a direction perpendicular to the rotation shaft J of the driving coupling 46, by a force acting in this disengagement direction of the unit 12, the driven coupling 47 rotationally moves so that the second engaging portion 47*f* approaches the contact surface 46*c*. At this time, the driven coupling 47 is in a position, as a center of the rotational movement, which is different from the rotation shaft J of the driving coupling 46 and where the driving coupling 46 and the driven coupling 47 contact each other.

As shown in (c) of FIG. 12 and (c) of FIG. 13, the second engaging portion positioned between the second engaging portion 47*f* and the first engaging portion 46*b* is hereinafter referred to as a second engaging portion 47*h*. Accordingly, a position k where the second engaging portion 47*h* and the contact 46*c* contact each other is the center of rotational movement.

When the driven coupling 47 starts the rotational movement at the position k as the center, the second engaging portion 47*f* approaches toward the contact surface 46*c* of the first engaging portion 46*b*, and therefore the gap between the second engaging portion 47*f* and the contact surface 46*c* is decreased. When the driven coupling 47 is rotationally moved, the second engaging portion positioned in a downstreammost side of the second engaging portions 47*a* with respect to the disengagement direction of the intermediary transfer belt unit 12 (hereinafter, this second engaging portion is referred to as a second engaging portion 47*g*) moves to the disengagement direction (the arrow M direction) of the belt unit 12 along the inclined surface 46*e*.

As a result, the driven coupling 47 retracts in the disengagement direction (the arrow M direction), and therefore as shown in (a) to (c) of FIG. 13, the engagement between the first engaging portion 46*b* and each of the second engaging portions 47*f*, 47*g* and 47*h* is eliminated. That is, from the contact surface 46*c* of the first engaging portion 46*b*, the contact surface of each of the second engaging portions 47*f*, 47*g* and 47*h* is separated (spaced). Until the engagement between the first engaging portion 46*b* and each of the second engaging portions 47*f*, 47*f* and 47*h* is eliminated, a distance in which a rotation shaft V of the driven coupling 47 moves in the unit disengagement direction relative to the rotation shaft J of the driving coupling 46 is β.

Next, when the belt unit 12 is pulled out in the direction perpendicular to the rotation shaft J of the driving coupling 46, a structure in which the rotation shaft V of the driven coupling 47 is movable in the disengagement direction relative to the rotation shaft J by the force acting in the disengagement direction will be described.

That is, as is understood from (a) to (d) of FIG. 11, the driven coupling 47 has a region which is sufficiently broad for engagement of the driving coupling 46 therein. As a result, a clearance is formed when the driving coupling 46 and the driven coupling 47 rotate in the engagement state.

As shown in (a) to (d) of FIG. 14, a maximum distance in which the rotation shaft J of the driven coupling 47 is movable in the unit disengagement direction (the arrow A direction) relative to the rotation shaft J of the driving coupling 46 is α.

The coupling portions (46, 47) in this embodiment are constituted so that the distance α is larger than the distance β. The distance α is not less than the distance β, whereby when the driven coupling 47 rotates at the position k as the center, the retraction of the driven coupling 47 in the arrow M direction is completed before the second engaging portion 47*f* contacts the first engaging portion 46*b*.

Accordingly, according to the constitution using the coupling portion in this embodiment, only by pulling out the belt unit 12 from the apparatus main assembly 50*a*, the engagement of the first engaging portion 46*b* with each of the second engaging portions 47*f*, 47*g* and 47*h* can be eliminated simply with reliability. As a result, the engagement between the driving coupling 46 and the driven coupling 47 can be eliminated simply. On the other hand, only by inserting the belt unit 12 into the apparatus main assembly 50*a* along the guiding portion 62 of the apparatus main assembly 50*a*, the belt unit 12 can be mounted in the apparatus main assembly 50*a* very simply with reliability.

In this embodiment, as described with reference to FIG. 15, in a series of mode switching operations, the flag gear 43 is rotated only in the CCW direction by the power of the driving motor 41, but only when the operation is switched from the operation in the monochromatic mode to the operation in the full-color mode, the driving motor 41 is rotated in the CW direction. Further, the position of the sensor 44 is disposed at the phase G for the full-color mode.

The reason thereof is that a sufficient gap with respect to the rotational direction is created between the second engaging portion 47*a* and the contact surface 46*c* of the first engaging portion 46 to enable simple disengagement of the intermediary transfer belt unit 12 from the apparatus main assembly 50*a*. In the switching, high in switching frequency, between the monochromatic mode and the full-color mode, when shortest switching is intended to be made by repetitively switching the motor rotational direction without disposing the sensor 44 at the phase for the full-color mode, there is a possibility that a deviation in stop phase of the flag portion 43*a* is accumulated. Also this problem is intended to be avoided.

An effect obtained by employing the constitution in this embodiment will be described while making reference to Comparison Example shown in (a) and (b) of FIG. 21.

Figure 21:
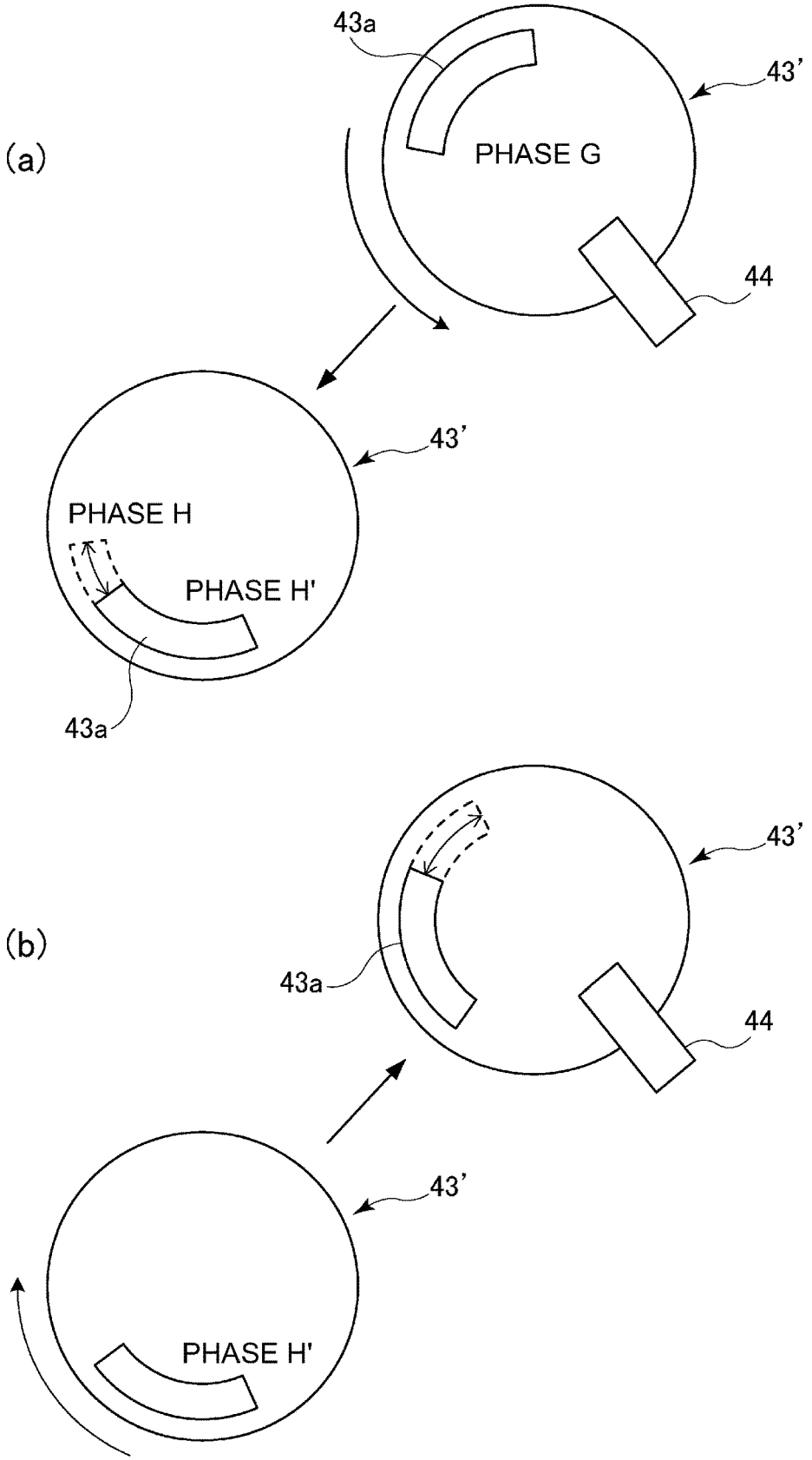
In FIG. 21, (a) and (b) are illustrations showing a constitution in Comparison Example.

In this Comparison Example, a constitution in which the sensor 44 detects the flag ON state by using a flag gear 43' when the flag is positioned at the position for the all separation mode as shown in (a) and (b) of FIG. 21 is employed. In this constitution, when the switching between the full-color mode and the monochromatic mode is made by repetitively switching the motor rotational direction, the deviation in stop position of the flag portion 43*a* is accumulated.

For example, in the case where the phase is switched from the phase G for the full-color mode to the phase H for the monochromatic mode, when the stop position of the flag portion 43*a* is deviated by disturbance as shown in (a) of FIG. 21, the operation starts from a phase H', not the phase H when the position is subsequently returned from the phase H to the phase G. For this reason, when the disturbance further occurs when the flag portion 43*a* stops at the phase G, there is a liability that the deviation is accelerated.

In this way, when the deviation in stop position is accumulated, the primary-transfer rollers compatible with the colors are rotated although the monochromatic mode is intended, so that there is a liability that problems that a lowering in lifetime of the apparatus is caused and that white paper is outputted by start of the image forming operation in the state in which all the primary-transfer rollers are separated occur.

On the other hand, according to the constitution in this embodiment, the switching is made in a shorter (shortest) time, and therefore even when the rotational direction of the driving motor 41 is repetitively switched, flag ON detection by the sensor 44 is made once per two switching operations, and therefore the image forming apparatus 50 can be operated with no accumulation of the error. As a result, it becomes possible to improve productivity without impairing the lifetime of the image forming apparatus 50.

Further, as another Comparison Example, it would be also considered that in order to prevent the error accumulation, flags different in width from each other are disposed at all of the phase positions of the flag gear. However, in this case, there is a need to always rotate the motor for distinguish the mode in order to detect the flag ON state in all of the modes, so that a problem such that the downtime is prolonged during power-on of the apparatus main assembly 50*a* and during reset of the apparatus main assembly 50*a* generates.

According to the constitution in this embodiment, the flag ON state is detected only at a home position (full-color mode), and therefore during the power-on of the apparatus main assembly 50*a* and during the reset of the apparatus main assembly 50*a*, the driving motor 41 may only be required to be rotated only in the case where the flag ON state is not detected, and therefore it is possible to alleviate the prolongation of the downtime.

Second Embodiment

Figure 22:
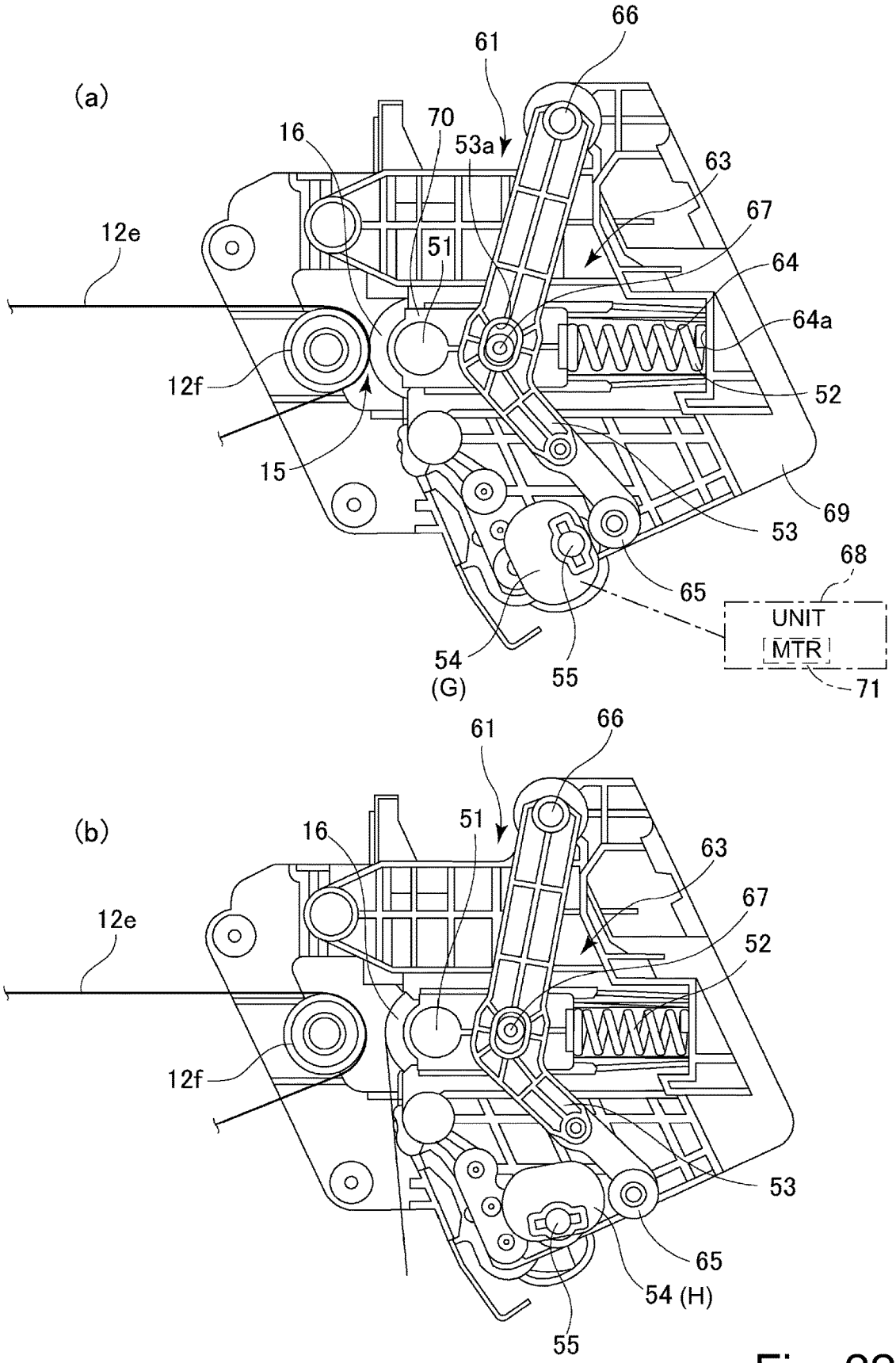
In FIG. 22, (a) is a sectional view of a state in which an outer secondary-transfer roller is contacted to a driving roller in Second Embodiment of the present invention, and (b) is a sectional view of a state in which the outer secondary-transfer roller is moved to a stand-by position.
Figure 23:
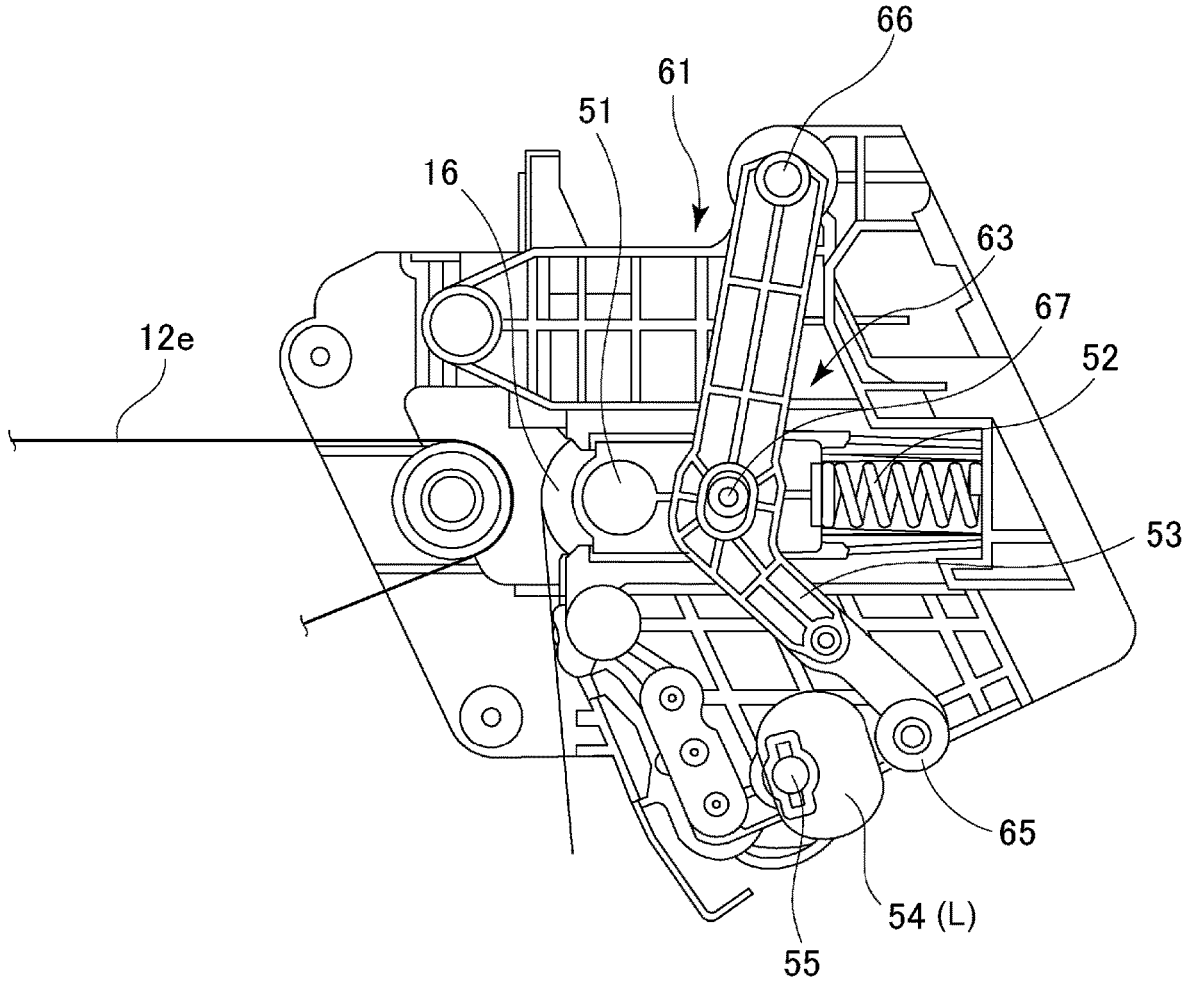
FIG. 23 is a sectional view of a state in which the outer secondary-transfer roller is moved to a separation position in Second Embodiment.

Second Embodiment in which the present invention is applied to the secondary-transfer unit 61 of the image forming apparatus 50 will be described with reference to FIGS. 22 and 23. In FIG. 22, (a) is a sectional view showing a state in which the outer state roller in this embodiment is contacted to the intermediary transfer belt toward the driving roller, and (b) is sectional view showing a state in which the outer secondary-transfer roller is moved to stand-by position. FIG. 23 is a sectional view showing a state in which the outer secondary-transfer roller is moved to a separation position. In this embodiment, the same members or portions as those in First Embodiment are represented by the same reference numerals or symbols, and the members or portions having the same structures and functions as those in First Embodiment will be omitted from description thereof.

As shown in (a) and (b) of FIG. 22, the secondary-transfer unit 61 detachably mountable to the apparatus main assembly 50*a* (FIG. 1) includes the outer secondary-transfer roller (transfer roller) 16, a roller contact-and-separation mechanism 63 for moving the outer secondary-transfer roller 16, and a contact-and-separation driving unit 68. The roller contact-and-separation mechanism 63 includes a supporting member 69 supported by the apparatus main assembly 50*a* of the image forming apparatus 50 so as to be disposed at a position opposing the driving roller (the inner secondary-transfer roller) 12*f*. The supporting member 69 is provided with a secondary-transfer arm 53 having a shape such that the secondary-transfer arm 53 is somewhat bent so as to be positioned at a central portion. At the central portion of the secondary-transfer arm 53, a rotational movement supporting hole 53*a* is formed.

On the supporting member 69, an accommodating portion 64 formed in a substantially rectilinear shape toward the driving roller 12*f* is formed. In the accommodating portion 64, a roller holder 70 is accommodated in a state in which the roller holder 70 is movable toward the driving roller 12*f* and is prevented from projecting toward the driving roller 12*f* more than the position shown in (a) of FIG. 22. In the accommodating portion 64, in a side of the roller holder 70 opposite from the driving roller 12*f*, a holder urging spring 52 consisting of a compression spring is provided in a compressed state between a rear end portion of the roller holder 70 and a bottom 64*a*.

The roller holder 70 is provided with a projected portion 67 projecting toward the front side in (a) and (b) of FIG. 22. This projected portion 67 is slidably inserted into the rotational movement supporting hole 53*a* of the secondary-transfer arm 53. The secondary-transfer arm 53 is supported, at a base end portion thereof, rotatably relative to the supporting member 69 by a rotational movement supporting shaft 66, and at a free end portion thereof, a rotatable circular plate-shaped member-to-be-urged 65 is supported.

By the above constitution, the outer secondary-transfer roller 16 is contacted (press-contacted) to the driving roller 12*f* by an urging force of the holder urging spring 52 in a state in which a rotation shaft 51 is held by the roller holder 70. The roller holder 70 and the outer secondary-transfer roller 16 are constituted so as to movable in a contact direction toward the driving roller 12*f* and a separation direction from the driving roller 12*f* by the secondary-transfer arm 53 held rotatably about the rotation movement supporting shaft 66 as the center. When the outer secondary-transfer roller 16 is moved in the contact direction, the outer secondary-transfer roller 16 is press-contacted to the driving roller 12*f* such that the intermediary transfer belt 12*e* is sandwiched between the outer secondary-transfer roller 16 and the driving roller 12*f*.

At a position where the supporting member 69 opposes the member-to-be-urged 65, a cam supporting shaft 55 for supporting an eccentric cam 54 is provided. The member-to-be-urged 65 is contacted to the eccentric cam 54, supported by the cam supporting shaft 55 in a state in which a center position is deviated, via the secondary-transfer arm 53 urged at the central portion by the holder urging spring 52.

In this embodiment, onto the intermediary transfer belt 12*e* as the image bearing member, the toner images carried on the photosensitive drums 1*a*-1*d* as other image bearing members are transferred. Further, the outer secondary-transfer roller (transfer roller) 16 as the member-to-be-moved form the secondary-transfer portion (nip) 15 between itself and the intermediary transfer belt 12*e*, and the toner images are transferred from the intermediary transfer belt 12*e* onto the recording material S passing through the secondary-transfer portion 15.

Then, the cam supporting shaft 55 is rotated by drive of a motor 71 consisting of the pulse motor provided in the contact-and-separation driving unit 68 in a state in which the cam supporting shaft 55 fixes and supports the eccentric cam 54 and is supported rotatably relative to the supporting member 69, thus rotating the eccentric cam 54. The eccentric cam 54 is rotated by the drive of the motor 71 driven by control by the controller 45 (FIG. 1) to change a contact position (contact phase) with the member-to-be-urged 65, whereby the outer secondary-transfer roller 16 is moved along a contact position, a stand-by position (intermediary position) and a separation position.

That is, different three positions of the outer secondary-transfer roller 16 relative to the intermediary transfer belt 12*e* are the contact position, the separation position and the stand-by position (intermediary position). The contact position is a position where the outer secondary-transfer roller 16 and the intermediary transfer belt 12*e* contact each other.

The separation position is a position where the secondary-transfer unit (transfer unit) 61 including the outer secondary-transfer roller 16 is detachably mountable to the apparatus main assembly 50*a* (FIG. 1) and where the outer secondary-transfer roller 16 and the intermediary transfer belt 12*e* are separated from each other. The stand-by position (intermediary position) is a position between the separation position and the contact position.

In this way, the controller 45 as the control means effects control so that the position of the outer secondary-transfer roller 16 is switched among the contact position, the stand-by position and the separation position by drive control of the motor (pulse motor) 71. In other words, the contact position is a position when the secondary-transfer is carried out during printing, and the stand-by position is a position where the outer secondary-transfer roller 16 is separated when the reference toner pattern (correction patch) is formed on the intermediary transfer belt during the printing. Further, the separation position is a separation position in a period other than during the printing. At the stand-by position, a necessary minimum separation amount in which the correction patch is not deposited on the outer secondary-transfer roller 16 in the case where the correction patch passes through the nip is ensured. At the separation position, a separation amount in consideration of a jam paper clearance property or an insertion and pulling-out property of the secondary-transfer unit 61 relative to the apparatus main assembly 50*a* during maintenance or transportation is ensured. In the present invention, the first position corresponds to the "contact position", the second position corresponds to the "stand-by position (intermediary position)", and the third position corresponds to the "separation position".

In this embodiment, the contact position, the stand-by position and the separation position correspond to the phase G, the phase H and the phase L (FIGS. 15 and 16), respectively, in First Embodiment. Also in such an embodiment, an effect substantially similar to the effect in First Embodiment can be obtained.

While the invention has been described with reference to the structures disclosed herein, it is not confined to the details set forth and this application is intended to cover such modifications or changes as may come within the purpose of the improvements or the scope of the following claims.

This application is a divisional of U.S. patent application Ser. No. 14/508,034, filed Oct. 7, 2014, which claims priority from Japanese Patent Application No. 212983/2013 filed Oct. 10, 2013, both of which are hereby incorporated by reference herein in their entirety.

What is claimed is:

1. An image forming apparatus comprising:

an image bearing member;

a motor rotatable hi-directionally;

a unit-to-be-moved configured to be moved so as to change a position thereof relative to said image bearing member;

a moving mechanism, including a cam rotated by said motor, configured to move said unit-to-be-moved to first to third positions by switching a phase of said cam to first to third phases corresponding to the first to third positions, respectively;

a sensor configured to detect only the first phase of said cam; and a controller configured to control drive of said motor on the basis of a detection result of said sensor, wherein said controller controls the drive of said motor so that switching between the first phase and the second phase is made by bi-directional rotation of said motor, wherein said controller controls the drive of said motor so that switching between the third phase and the first phase is made by unidirectional rotation or bi-directional rotation of said motor, and wherein said controller controls the drive of said motor so that switching between the second phase and the third phase is made by rotation of said motor in one direction and is not made by rotation of said motor in the other direction.

2. The image forming apparatus according to claim 1, wherein said controller controls the drive of said motor so as to permit switching from the second position to the third position without passing through the first position and so as not to permit switching from the third position to the second position without passing through the first position and so as to permit switching from the third position to the first position without passing through the second position.

3. The image forming apparatus according to claim 2, wherein said controller controls the drive of said motor so as not to permit switching from the first phase to the third phase by the rotation of said motor in the second direction.

4. The image forming apparatus according to claim 2, wherein said controller controls the drive of said motor so as to permit switching from the third position to the first position without passing through the second position.

5. The image forming apparatus according to claim 1, wherein said image bearing member includes a plurality of photosensitive members each for carrying a toner image, wherein said unit-to-be-moved is an intermediary transfer belt onto which the toner images are to be transferred from the plurality of photosensitive members, respectively, and wherein the first position is an all contact position where all of the plurality of photosensitive members contact the intermediary transfer belt, the second position is a partial contact position where a part of the plurality of photosensitive members contacts the intermediary transfer belt, and the third position is an all separation position where all of the plurality of photosensitive members are separated from the intermediary transfer belt.

6. The image forming apparatus according to claim 5, wherein said image forming apparatus is capable of executing an operation in a first image forming mode and an operation in a second image forming mode, and wherein said controller controls the drive of said motor so that the phase of said cam is the first phase during execution of the operation in the first image forming mode and so that the phase of said cam is the second phase during execution of the operation in the second image forming mode.

7. The image forming apparatus according to claim 5, further comprising an intermediary transfer unit which includes the intermediary transfer belt and which is mountable to and dismountable from a main assembly of said image forming apparatus, wherein when the phase of said cam is in the third phase, said intermediary transfer unit is mountable to and dismountable from the main assembly of said image forming apparatus.

8. The image forming apparatus according to claim 1, wherein said image bearing member is an intermediary transfer belt onto which toner images are to be transferred, and wherein said unit-to-be-moved is a secondary transfer member configured to transfer the toner images to a recording material.

9. The image forming apparatus according to claim 8, wherein the first position is a contact position where the secondary transfer member contacts the intermediary transfer belt, the second position is a first separation position where the secondary transfer member is separated from the intermediary transfer belt at a first distance, and the third position is a second separation position where the secondary transfer member is separated from the intermediary transfer belt at a second distance longer than the first distance.

10. The image forming apparatus according to claim 1, wherein in a case where drive of said motor is stopped in the first phase from the second phase, said controller controls said motor on the basis of a first driving pulse determined in advance, and wherein in a case where drive of said motor is stopped in the second and third phases from the first phase, said controller controls said motor on the basis a second driving pulse determined in advance and the detecting result of the sensor.

* * * * *